US010265576B2

(12) United States Patent
Kamins

(10) Patent No.: US 10,265,576 B2
(45) **Date of Patent: *Apr. 23, 2019**

(54) LOWER BODY FITNESS APPARATUS FOR PROVIDING ENHANCED MUSCLE ENGAGEMENT, BODY STABILITY AND RANGE OF MOTION

(71) Applicant: Paul Kamins, Lancaster, NH (US)

(72) Inventor: Paul Kamins, Lancaster, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/183,537

(22) Filed: Jun. 15, 2016

(65) Prior Publication Data

US 2016/0296784 A1 Oct. 13, 2016

Related U.S. Application Data

(63) Continuation-in-part of application No. 14/876,811, filed on Oct. 6, 2015, now abandoned, which is a (Continued)

(51) Int. Cl.
*A63B 23/035* (2006.01)
*A63B 23/04* (2006.01)
(Continued)

(52) U.S. Cl.
CPC ..... *A63B 23/0482* (2013.01); *A63B 21/0552* (2013.01); *A63B 21/062* (2013.01); (Continued)

(58) Field of Classification Search
CPC ..... A63B 21/154; A63B 21/02; A63B 21/04; A63B 21/0442; A63B 21/0617; A63B 21/4011; A63B 21/4013; A63B 21/4015; A63B 21/156; A63B 21/062; A63B 21/0622; A63B 21/0624; A63B 21/0628; (Continued)

(56) References Cited

U.S. PATENT DOCUMENTS 804,218 A * 11/1905 Fiedler ..... A63B 21/0628 482/102
3,428,312 A 2/1969 Machen
(Continued)

*Primary Examiner* — Nyca T Nguyen
(74) *Attorney, Agent, or Firm* — Joseph Aufiero

(57) ABSTRACT

A lower body fitness apparatus is disclosed, which provides enhanced gluteal muscle engagement, body stability, and range of motion. The apparatus includes a base, a frame, a line-swiveling assembly, and a gripping device that is horizontally displaced from the line-swiveling assembly's swivel axis, allowing a user to stabilize themselves in tripod posture during exercise. Thus a user can perform full range of motion for any combination of hip extension and hip abduction under resistance transmitted by a line, all from a central standing position that substantially straddles the swivel axis. This functional framework of elements can be realized through a variety of possible embodiments. While the frame provides space for leaning during exercise, it may otherwise vary in structural design. The line's resistance can be generated by any means contemplated by one of ordinary skill, such as lifting weight, stretching an elastic band, bending a flexible rod, or other means.

18 Claims, 17 Drawing Sheets

Related U.S. Application Data continuation-in-part of application No. 14/876,810, filed on Oct. 6, 2015, now abandoned.

(60) Provisional application No. 62/060,556, filed on Oct. 6, 2014.

(51) Int. Cl.

| | |
|---|---|
| ***A63B 21/00*** | (2006.01) |
| ***A63B 21/02*** | (2006.01) |
| ***A63B 21/062*** | (2006.01) |
| ***A63B 21/055*** | (2006.01) |
| *A63B 21/075* | (2006.01) |
| *A63B 71/06* | (2006.01) |

(52) U.S. Cl.

CPC ..... *A63B 21/0628* (2015.10); *A63B 21/154* (2013.01); *A63B 21/4034* (2015.10); *A63B 23/03508* (2013.01); *A63B 21/023* (2013.01); *A63B 21/055* (2013.01); *A63B 21/0557* (2013.01); *A63B 21/075* (2013.01); *A63B 21/156* (2013.01); *A63B 21/4013* (2015.10); *A63B 21/4015* (2015.10); *A63B 21/4035* (2015.10); *A63B 23/0405* (2013.01); *A63B 23/0488* (2013.01); *A63B 2071/0647* (2013.01); *A63B 2208/0204* (2013.01); *A63B 2208/0209* (2013.01); *A63B 2210/50* (2013.01); *A63B 2220/806* (2013.01); *A63B 2220/807* (2013.01); *A63B 2225/093* (2013.01)

(58) Field of Classification Search

CPC ..... A63B 21/159; A63B 21/08; A63B 21/15; A63B 23/0482; A63B 23/0488; A63B 23/0211; A63B 23/0405; A63B 23/0476; A63B 21/151

See application file for complete search history.

(56) References Cited

U.S. PATENT DOCUMENTS

| | | | | |
|---|---|---|---|---|
| 3,861,675 | A * | 1/1975 | Hopper | A63B 69/12 482/55 |
| 4,749,189 | A * | 6/1988 | Frank | A63B 21/023 482/129 |
| 4,826,153 | A * | 5/1989 | Schalip | A63B 21/06 482/94 |
| 5,405,306 | A * | 4/1995 | Goldsmith | A61H 1/0237 482/110 |
| 5,842,961 | A * | 12/1998 | Davis | A63B 23/00 482/102 |
| 6,005,248 | A * | 12/1999 | Mori | G01R 31/307 250/311 |
| 7,137,935 | B2 | 11/2006 | Clarke | |
| 7,470,221 | B1 * | 12/2008 | Ramos | A63B 21/154 482/100 |
| 7,682,298 | B2 | 3/2010 | Croft | |
| 8,608,479 | B2 * | 12/2013 | Liu | A61H 1/024 434/255 |
| 8,876,675 | B2 * | 11/2014 | Califano | A63B 21/4015 482/121 |
| 8,968,167 | B1 * | 3/2015 | Abelbeck | A63B 21/0442 482/129 |
| 2002/0016238 | A1 * | 2/2002 | Roy | A63B 21/063 482/94 |
| 2003/0069112 | A1 * | 4/2003 | Williams | A63B 21/154 482/101 |
| 2005/0043150 | A1 * | 2/2005 | Nitta | A63B 21/026 482/79 |
| 2005/0130814 | A1 * | 6/2005 | Nitta | A63B 1/00 482/121 |
| 2006/0128536 | A1 * | 6/2006 | Herrington | A63B 21/0628 482/94 |
| 2006/0135329 | A1 * | 6/2006 | Owen | A63B 21/04 482/123 |
| 2009/0105052 | A1 * | 4/2009 | Dalebout | A63B 21/06 482/133 |
| 2012/0035024 | A1 * | 2/2012 | Price | A63B 21/00072 482/92 |

* cited by examiner

PRIOR ART

EXTENSION

THE 45$^0$

ABDUCTION

ADDUCTION

LOWER BODY FITNESS APPARATUS FOR PROVIDING ENHANCED MUSCLE ENGAGEMENT, BODY STABILITY AND RANGE OF MOTION

CROSS-REFERENCE TO RELATED APPLICATIONS

This present application is a continuation-in-part of applicant's co-pending application Ser. No. 14/876,810, filed Oct. 6, 2015 and entitled "Stowable Lower Body Fitness Apparatus Providing Enhanced Muscle Engagement, Body Stability and Range of Motion," which itself claims the benefit of Provisional Application 62/060,556, filed Oct. 6, 2014—and the disclosure of application Ser. No. 14/876,810 is also hereby incorporated by reference in its entirety into the present application. The present application is also a continuation-in-part of applicant's co-pending application Ser. No. 14/876,811, filed Oct. 6, 2015 and entitled "Lower Extremity Receiving Device for Providing Enhanced Leg Mobility During Lower Body Exercise," which itself also claims the benefit of Provisional Application 62/060,556, filed Oct. 6, 2014—and the disclosure of application Ser. No. 14/876,811 is also hereby incorporated by reference in its entirety into the present application.

FIELD

This invention relates generally to fitness equipment, and more particularly to lower body fitness equipment.

BACKGROUND

In addition to being an integral part of an individual's overall physical fitness, toned and shapely buttocks and legs have also become desirable due to their perceived physical attractiveness. As a result, the market for lower body exercise machines and devices has grown in recent years, especially among women. Many such machines and devices are known in the art.

One class of exercise machine for the buttocks involves a resistance-transmitting line, such as a weight machine cable, coupled at a pullable end with a user's leg. Lower body fitness machines that are designed as cable machines can continuously transmit resistance during extension and/or abduction of the user's hip, which in turn can work the gluteal muscles and enhance sculpting of the buttocks.

However, while use of a resistance-transmitting line machine can be an effective general method of muscle exercise, its use for buttocks exercise poses certain problems. In particular, it can be difficult for the user of a particular machine to fully engage all of their gluteal muscles. Furthermore, attempts to do so could compromise the user's posture, leading to discomfort or potentially even injury.

SUMMARY

Various embodiments of an improved lower body fitness apparatus are disclosed, which provide enhanced gluteal muscle engagement, body stability and range of motion. Unlike other known cable machines for lower body exercise, the present invention safely and efficiently provides maximal engagement of all gluteal muscles, sparing the user from undue discomfort and/or wasted effort in the process.

The improved performance of the present invention is facilitated by the strategic placement of a line-swiveling assembly that enables a resistance-transmitting line to swivel about a vertical swivel axis. A gripping device is positioned relative to the swivel axis to allow for effective and even exercise of the entire buttocks, along with increased range of motion and continuous proper stability and body alignment.

By positioning the grip locus relative to the swivel axis in accordance with embodiments disclosed below, a new unanticipated synergistic effect is created which leads to optimal gluteal muscle exercise. From a single stance, the user can perform the full range of any combination of hip extension and/or hip abduction under resistance with either leg, easily switching from side to side, all while constantly stabilizing themselves in a balanced tripod posture.

Due to the efficient form and posture afforded by the present invention during use, a user not only can work their gluteal muscles with greater efficiency and comfort, but also can lift more weight and follow through with more rigorous and strength-building movement than other gluteal exercise techniques typically allow. Finally, because the present invention enables streamlined straight-legged exercise, there is no excessive pressure imposed on the knees or other joints (such as may occur from squats or lunges, for example), thus making its basic design highly ergonomic.

In one general aspect, a lower body fitness apparatus is claimed which comprises: a base; a frame attached to and supported by the base; a line-swiveling assembly coupled with the base the line-swiveling assembly configured to engage with a resistance-transmitting line, to enable a pullable end of the line to swivel about a vertical swivel axis to allow a user to pull the pullable end with an exercising leg to perform full range of motion for any combination of hip extension and hip abduction under resistance from a single standing position that substantially straddles the swivel axis; a gripping device connected to the frame the gripping device including a plurality of grippable areas positioned along a substantially horizontal grip locus (the grip locus being sufficiently positioned relative to the swivel axis to allow the user to stabilize themselves in a tripod posture formed by both arms and a standing leg during the any combination of hip extension and hip abduction); and a leaning space passing through the swivel axis, the leaning space having sufficient volume to allow the user to lean their upper body to achieve full range of exercise motion during the any combination of hip extension and hip abduction.

In some embodiments, the line-swiveling assembly and the frame are configured to enable a user to pull the pullable end of the line with an exercising leg to perform hip flexion. In other embodiments, the apparatus further comprises a resistance adjustment system. In some embodiments, the line-swiveling assembly includes a swiveling pulley coupled with the resistance-transmitting line, the swiveling pulley being free to swivel about the swivel axis. In other embodiments, the apparatus further comprises an intermediate guiding pulley positioned no higher than substantially hip height. In still other embodiments, the apparatus further comprises a resistance-activating pulley assembly coupled with the frame, the resistance-activating pulley assembly being configured to engage with the resistance-transmitting line to facilitate activation of a resistance-generating element.

In some embodiments, the resistance transmitted by the resistance-transmitting line is generated by lifting of an exercise weight that is connected to a resistance-bearing end of the resistance-transmitting line. In other embodiments, the resistance transmitted by the resistance-transmitting line is generated by stretching of an elastic resistance band that is connected to a resistance-bearing end of the resistance-transmitting line. In some embodiments, the resistance transmitted by the resistance-transmitting line is generated by bending of a flexible resistance rod that is connected to a resistance-bearing end of the resistance-transmitting line. In other embodiments, the resistance transmitted by the resistance-transmitting line is generated by twisting of a torsional resistance disc that is connected to a resistance-bearing end of the resistance-transmitting line. In still other embodiments, the pullable end of the resistance-transmitting line is connected to a lower extremity receiving device, the lower extremity receiving device being configured to receive the user's lower extremity and thereby engage with the user's leg.

In some embodiments, the gripping device is configured to support a user during hip adduction. In other embodiments, the gripping device includes a straight bar positioned along a horizontal grip axis. In some embodiments, the gripping device includes a plurality of handlebars positioned along the grip locus. In other embodiments, the gripping device includes two grippable areas positioned substantially at least shoulders width apart along the grip locus. In some embodiments, the grip locus is substantially at least forearm length from the swivel axis. In other embodiments, the gripping device is height-adjustable. In still other embodiments, a swivel-grip displacement adjustment system, the swivel-grip adjustment system being configured to enable adjustment of displacement between the swivel axis and the grip locus.

In another general aspect, a lower body fitness apparatus is claimed which comprises: a base; a frame attached to and supported by the base; a swiveling pulley coupled with the base, the swiveling pulley being configured to engage with a resistance-transmitting line, to enable a pullable end of the line to swivel about a vertical swivel axis to allow a user to pull the pullable end with an exercising leg to perform full range of motion for any combination of hip extension and hip abduction under resistance from a single standing position that substantially straddles the swivel axis; a weight-lifting pulley assembly coupled with the frame, the weight-lifting pulley assembly being configured to engage with the line to facilitate lifting of a liftable exercise weight when the pullable end is pulled with sufficient force; a gripping device connected to the frame the gripping device including a plurality of grippable areas positioned along a substantially horizontal grip locus, (the grip locus being sufficiently positioned relative to the swivel axis to allow the user to stabilize themselves in a tripod posture formed by both arms and a standing leg during the any combination of hip extension and hip abduction); and a leaning space passing through the swivel axis, the leaning space having sufficient volume to allow the user to lean their upper body to achieve full range of exercise motion during the any combination of hip extension and hip abduction.

In yet another general aspect, a lower body fitness apparatus is claimed which comprises: a base; a frame attached to and supported by the base; a swiveling pulley coupled with the base, the swiveling pulley being configured to engage with an resistance-transmitting line, to enable a pullable end of the line to swivel about a vertical swivel axis to allow a user to pull the pullable end with an exercising leg to perform full range of motion for any combination of hip extension and hip abduction under resistance from a single standing position that substantially straddles the swivel axis; a band-stretching pulley assembly coupled with the frame, the band-stretching pulley assembly being configured to engage with the line to facilitate stretching of an elastic resistance band when the pullable end is pulled with sufficient force; a gripping device connected to the frame, the gripping device including a plurality of grippable areas positioned along a substantially horizontal grip locus (the grip locus being sufficiently positioned relative to the swivel axis to allow the user to stabilize themselves in a tripod posture formed by both arms and a standing leg during the any combination of hip extension and hip abduction); and a leaning space passing through the swivel axis, the leaning space having sufficient volume to allow the user to lean their upper body to achieve full range of exercise motion during the any combination of hip extension and hip abduction.

BRIEF DESCRIPTION OF THE DRAWINGS

The invention will be more fully understood by reference to the detailed description, in conjunction with the following figures, wherein:

FIG. 1 is a front oblique view of a prior art embodiment of a lower body fitness apparatus also being used to perform hip extension;

FIG. 2 is a front oblique view of another prior art embodiment of a lower body fitness apparatus being used to perform hip extension;

FIGS. 3-5 introduce an illustrative embodiment and basic functional framework of the invention, specifically:

FIGS. 6-15 introduce exemplary machine embodiments of the invention, specifically:

FIG. 6 is a profile view of a possible commercial embodiment of the invention being used to fully perform hip extension;

FIG. 7 is a front oblique view of another embodiment of the invention including an open-ended frame;

FIG. 8 is a profile view of the embodiment of FIG. 7 being used to fully perform hip extension;

FIG. 9 is a profile view of the embodiment of FIG. 7 also including a gluteal exercise monitoring system;

FIG. 10 is a profile view of the embodiment of FIG. 7 being used to perform hip flexion;

FIG. 11 is a front oblique view of another embodiment of the present invention including a frame with a minimalist design;

FIG. 13 is a front oblique view of another embodiment of the present invention including an elastic band for generating resistance;

FIG. 14 is a front oblique view of another embodiment of the present invention designed to mount to a wall; and FIG. 15 is a front oblique view of another embodiment of the present invention that uses a flexible rod to generate resistance.

DETAILED DESCRIPTION

The gluteal muscles are often considered the powerhouse of the body and an essential part of the body's "core," and as such, they are of central focus in strength training and physical fitness. Toning of the gluteal muscles also holds substantial aesthetic appeal, particularly for female physiques. However, traditional exercises for targeting the gluteal muscles require weightlifting in a variety of difficult and/or uncomfortable postures.

Given the growing desire among women to build their gluteal muscles, the demand for more ergonomic gym machines that can effectively target this area of the body has increased substantially. While some resistance-transmitting line machines seemingly offer comparatively comfortable gluteal workout routines, their perceived comfort actually comes at the expense of optimal gluteal muscle engagement.

The following detailed description corresponds with the accompanying drawings. First, known devices from the prior art which attempt to provide for gluteal muscle exercise are surveyed. The main features of these devices are summarized, along with their key benefits and also some of their failings. Following this prior art survey, the current inventive concept is explained by reference to a functional framework and various possible embodiments.

Relevant Prior Art Designs

Figure 1:
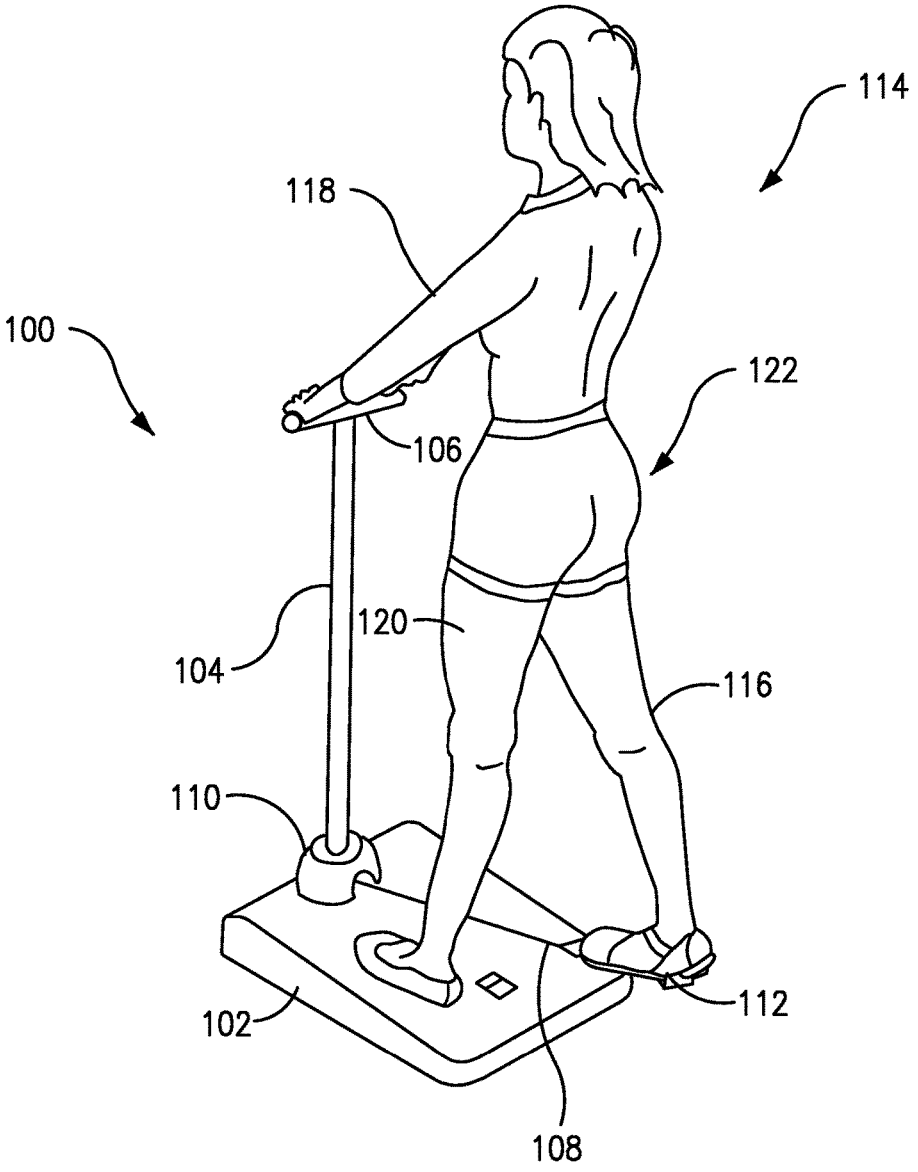
FIGS. 1-2 introduce prior art designs relevant to the invention, specifically.
Figure 2:
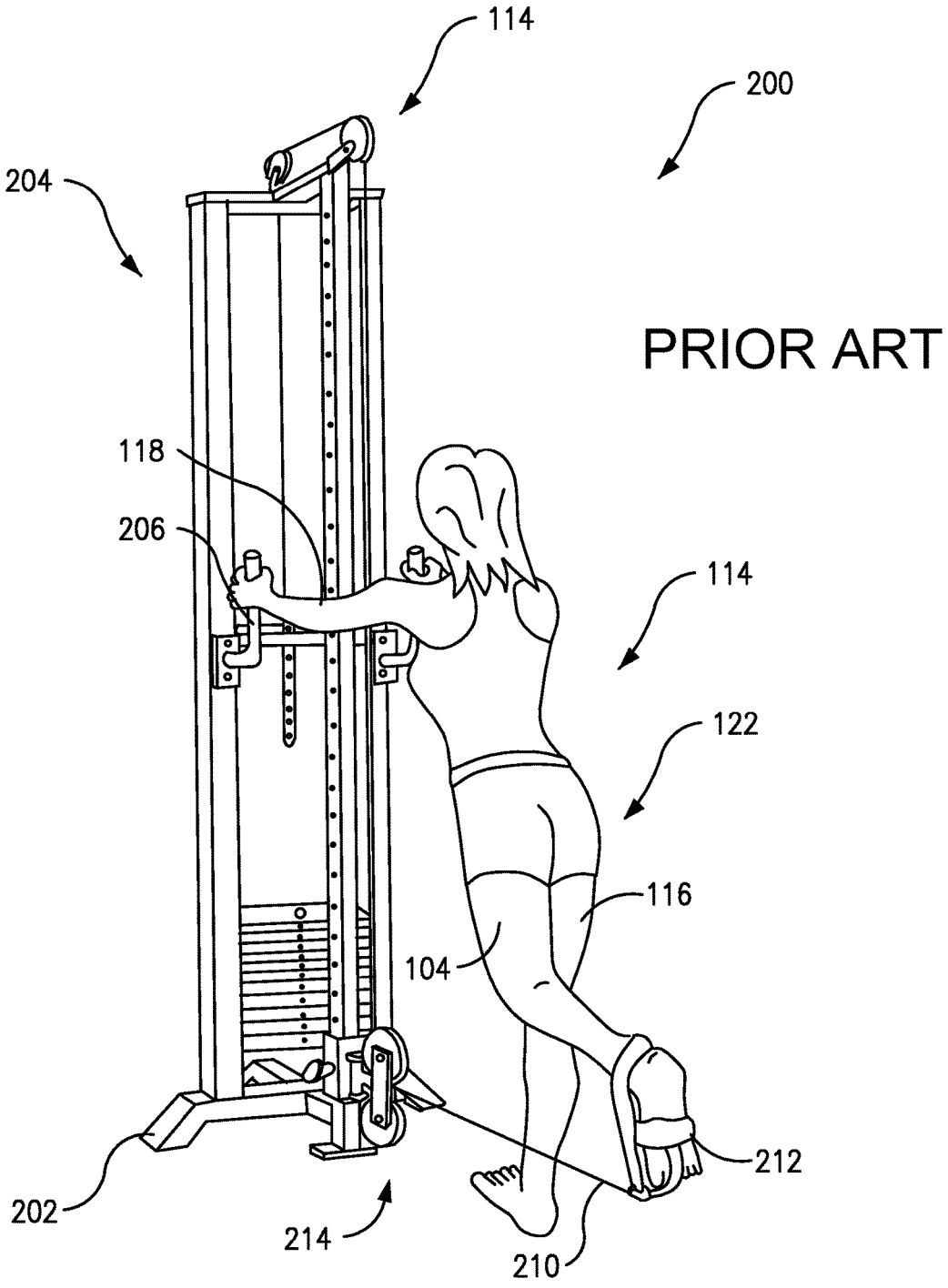

FIGS. 1 and 2 introduce prior art designs relevant to the invention, specifically: FIG. 1 is a front oblique view of a prior art embodiment of a lower body fitness apparatus being used to perform hip extension; and FIG. 2 is a front oblique view of another prior art embodiment of a lower body fitness apparatus also being used to perform hip extension. The pros and cons of each embodiment are discussed as an introduction to a detailed discussion of the present inventive concept.

1

FIG. 1 is a front oblique view of a prior art embodiment 100 of a lower body fitness apparatus being used to perform hip extension. The device shown 100 includes a base 102, a post 104 attached to and supported by the base 102, a horizontal gripping handle 106 atop the post 104, and a resistance-transmitting line 108 that passes through the post 104, emerging from the post bottom 110 to connect at the line's pullable end to a customized exercise shoe 112.

The line 108 connects specifically to a front end of the customized shoe 112. A user 114 can manually fasten the customized shoe 112 to the foot of an exercising leg 116. Then, the user 114 can stabilize their upper body with their arms 118 by gripping the gripping handle 106, while also supporting their lower body with their standing leg 120 as they exercise with their exercising leg 116. The line 108 transmits resistance, generated by an internal spring in the post 104, against the pulling of the exercising leg 116 of the user 114.

This arrangement enables a user 114 to extend their hip under resistance transmitted by the line 108. By pulling their exercising leg 116 backwards the user 114 extends their hip, thereby activating their gluteus maximus muscle 122. In particular, this device 100 is useful for middle ranges of hip extension, not accompanied by hip abduction (lateral leg movement). The gripping handle 106, the pathway of the line 108, and the design of the customized shoe 112 all promote this motion.

However, several limitations of this device 100 prevent optimal targeting of the gluteal muscles. While hip extension does activate the gluteus maximus 116, the full possible range of hip extension is not allowable here. Furthermore, even the greatest range of hip extension cannot effectively target all gluteal muscles, particularly the gluteus medius and minimus. These limitations lead to incomplete engagement of the gluteal muscles.

For exceptional gluteal muscle building results, all gluteal muscles should be properly engaged. Exercising only the gluteus maximus produces unbalanced results. Hip abduction is required to target the gluteus medius and minimus, as well as to perfect gluteus maximus exercise. Ideally, hip abduction is achieved by adding a lateral component to leg motion, whereby the exercising leg 116 moves at least partially laterally sideways. However, this motion is not possible with the machine shown.

The design of the device shown 100 undermines hip abduction. For example, its customized shoe 112 compels the exercising foot to remain pointed towards the support post 110, preventing proper form for abduction. The resistance is generated by a spring, with limited adjustability, thereby potentially limiting the extent of pulling of the line 108. The resistance-transmitting line 108 is restricted from being adequately swiveled laterally for full hip abduction, due to a restrictive structural assembly at the bottom of the post 104. And even if hip abduction were possible, the small handle 106 would prevent a user 116 from properly stabilizing themselves during the leg's sideways motion.

2

FIG. 2 is a front oblique view of more modern embodiment 200 of a lower body fitness apparatus also being used to perform hip extension. This device 200 includes a base 202, a frame 204 attached to and supported by the base 202, a pair of handles 206 attached to the frame 204, a weightlifting assembly 208 connected to the frame 204, and a weight machine cable 210 coupled with the weightlifting assembly 208, and connecting at its pullable end to a customized foot attachment 212.

A height-adjustable swiveling pulley assembly 214 is attached to the bottom of a portion of the frame 204. The weight machine cable 210 is fed vertically into the swiveling pulley assembly 214, and the pullable end of the cable 210 exits the swiveling pulley assembly 214 in the horizontal direction. In this embodiment, a user can achieve a wider grip than in the prior art of FIG. 1 and they can move their leg partly in the lateral direction, thus enabling some hip abduction as well as hip extension.

Considering this design, gluteal exercise seems to be more advantageous. The handles 206 provide for wider and elevated grip. The cable 210 is not bound at a fixed point like the spring-activated cable of FIG. 1, and it can therefore likely be pulled through a longer pathway. The swiveling pulley assembly 214 allows for a substantial amount of swiveling of the pullable end of the cable 210 about a vertical axis, and the foot strap attachment 212 allows for some rotation of the foot. But while this design includes some apparent benefits over the prior art of FIG. 1, it leaves more to be desired.

Looking more closely at what may at first seem like an accommodating design, this prior art machine 200 includes a major complication. Unlike the prior art design of FIG. 1, this machine 200 does not allow a user to lean forward into the space beyond the vertical axis of the pulley's 214 swiveling action. Without being able to lean forward, a user cannot achieve proper form during hip extension, and thus even their range of allowable hip extension motion is severely limited.

Additionally, despite the apparent improvements of this design over FIG. 1, even this device 200 enables hip abduction only in limited ways. For example, a user that wishes to supplement their hip extension with partial hip abduction must shuffle sideways to induce the bulky pulley assembly 214 to swivel laterally, in proportion to their desired leg movement. The greater the desired hip abduction, the greater the required shuffle, and the less comfortable or forgiving the fixed, non-adjustable 206 grips will be as a result.

In addition to poor grip during abduction, the user's posture is compromised. Forced by the handles 206 and frame 204 to keep the torso erect, their lower back is easily strained during abduction. For straight abduction (unaccompanied by extension), the user must turn their body a full 90 degrees, but they can then only stabilize their body with a single arm, gripping only one handle—and in that instance, the arm is awkwardly oriented perpendicular to the orientation of the user during their exercise.

Basic Functional Framework

Figure 3A:
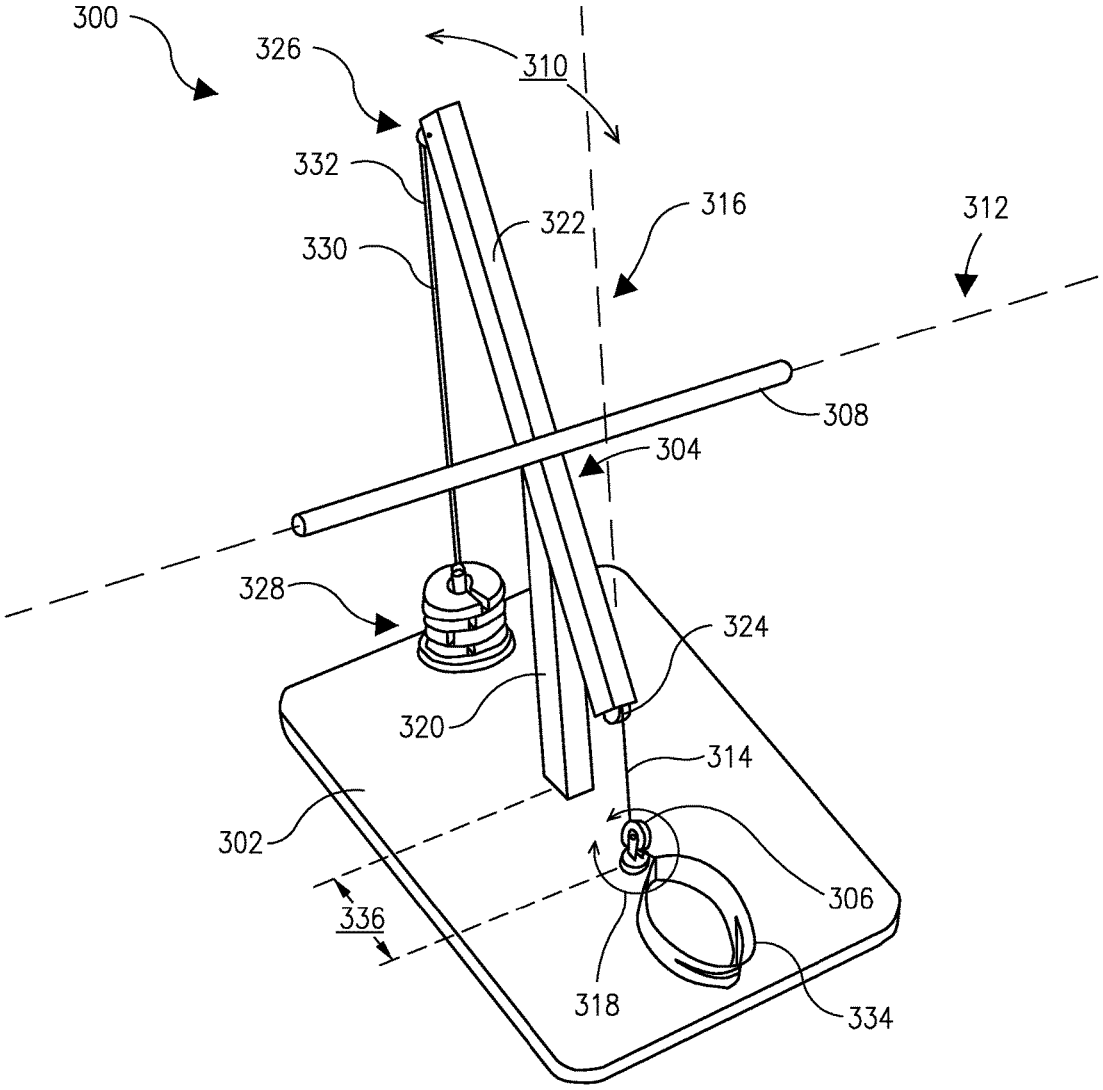
FIG. 3A is a front oblique view of an illustrative embodiment of the present invention.
Figure 3B:
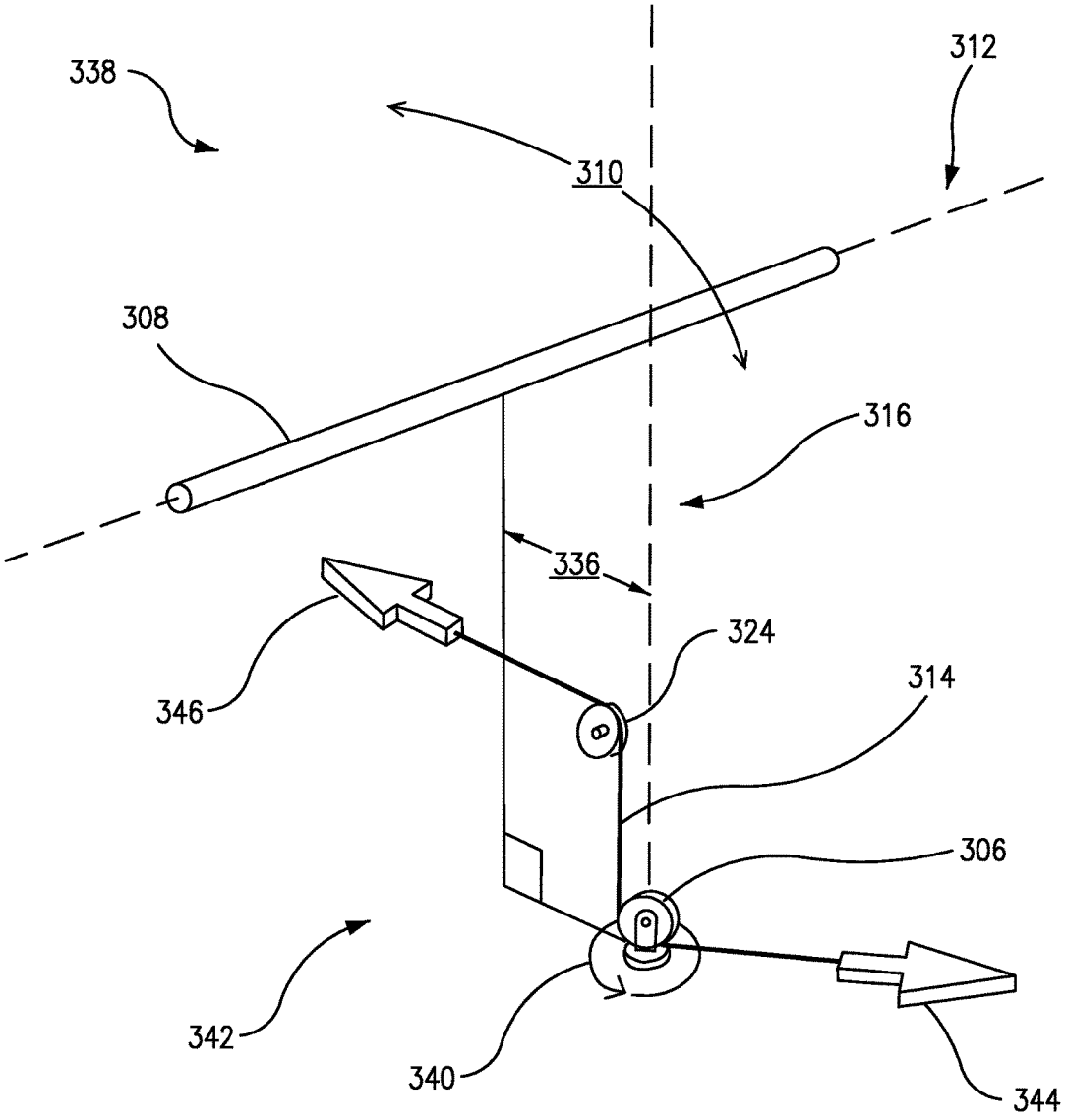
FIG. 3B is a perspective view of a functional framework of the illustrative embodiment.
Figure 3C:
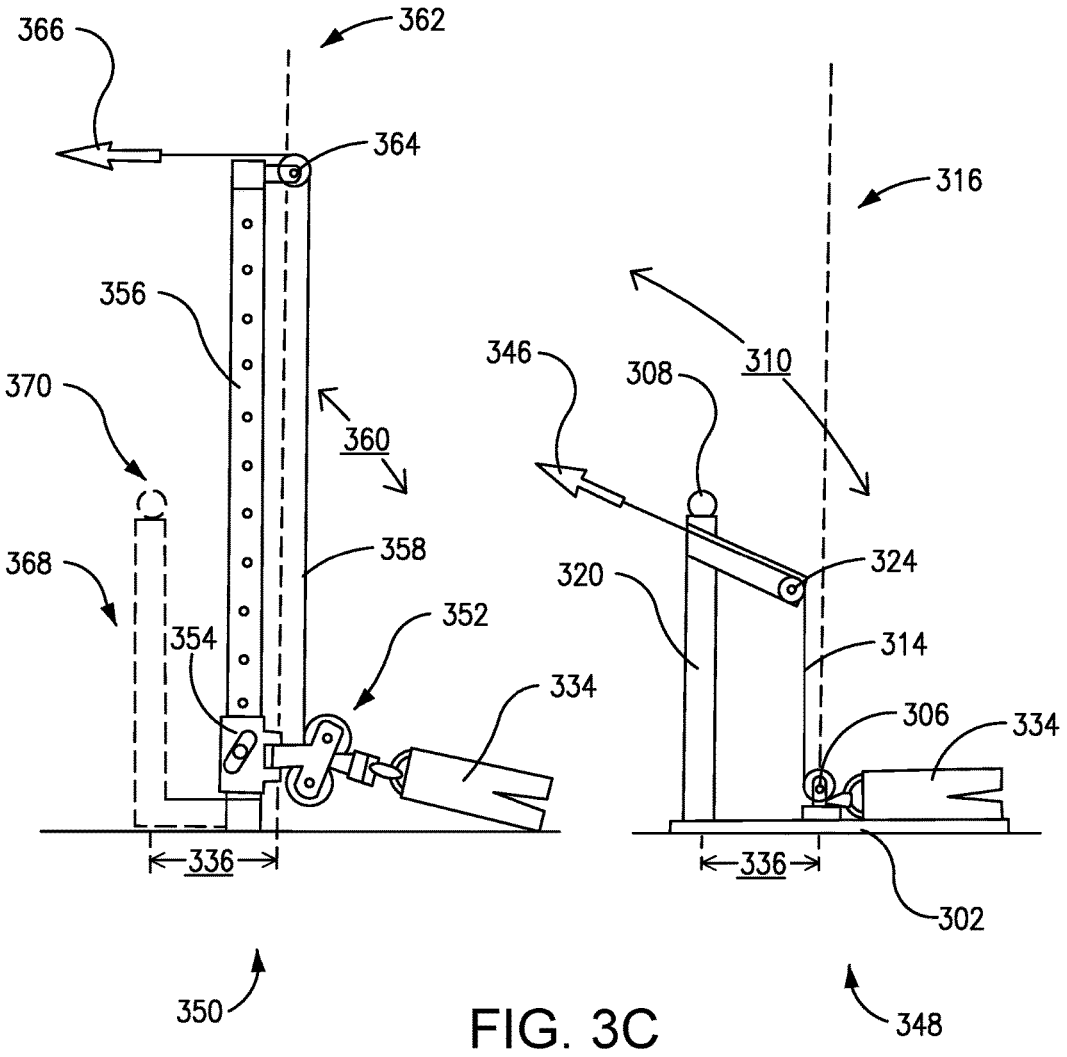
FIG. 3C is a profile view of the grip-swivel portion of the illustrative embodiment as shown and described in FIG. 3A alongside a hypothetical grip-swivel portion of a multipurpose exercise machine.
Figure 4A:
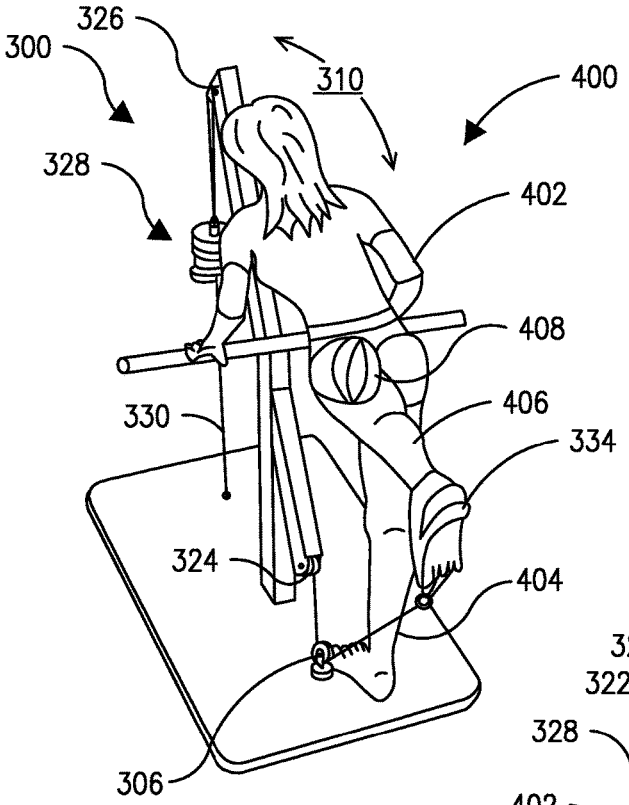
FIG. 4A is a front oblique view of the embodiment of FIG. 3A being used to perform hip extension.
Figure 4B:
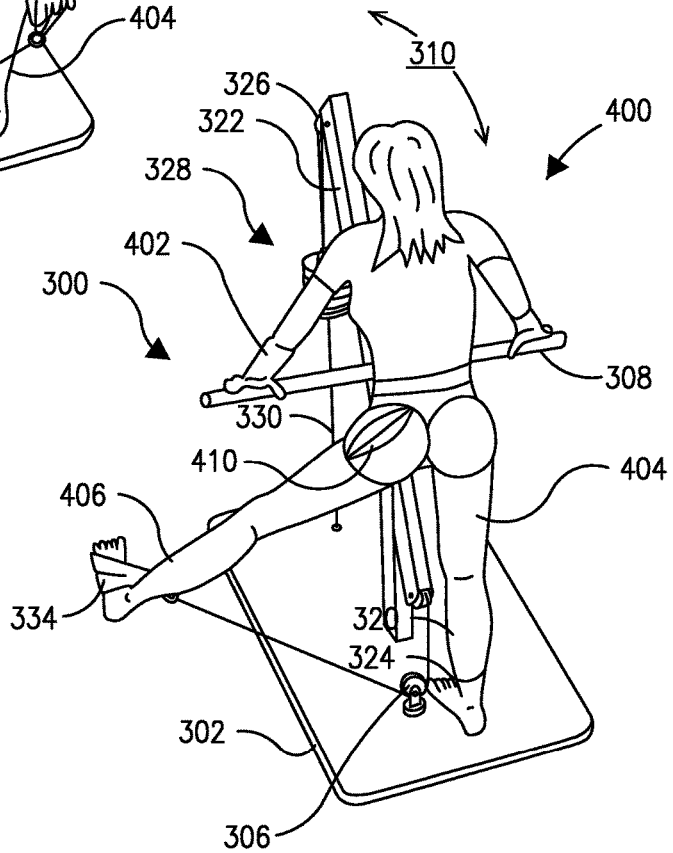
FIG. 4B is a front oblique view of the embodiment of FIG. 3A being used to perform hip abduction.
Figure 5A:
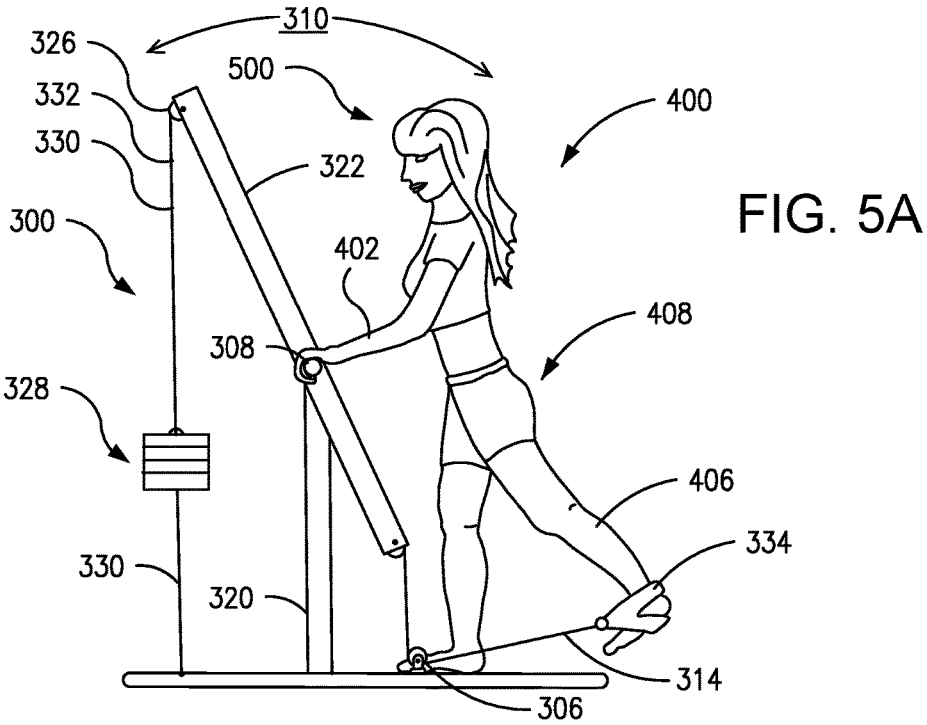
FIG. 5A is a profile view of the embodiment of FIG. 3A being used to begin hip extension.
Figure 5B:
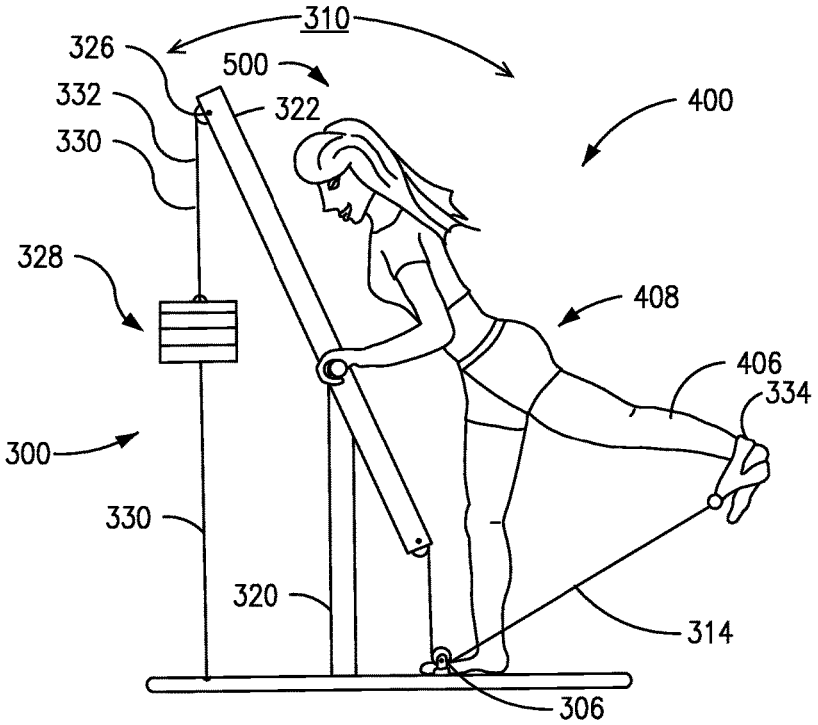
FIG. 5B is a profile view of the embodiment of FIG. 3A being used to complete hip extension.

FIGS. 3-5 introduce some basic structure and function of the invention, specifically: FIG. 3A is a front oblique abstract view of an illustrative embodiment of the present invention; FIG. 3B is a perspective view of a functional framework of the illustrative embodiment; FIG. 3C is a profile view of the grip-swivel portion of the illustrative embodiment as shown and described in FIG. 3A alongside a hypothetical grip-swivel portion of a multipurpose exercise machine; FIGS. 4A and 4B are front oblique views of the embodiment of FIG. 3A being used to perform hip extension and hip abduction, respectively; and FIGS. 5A and 5B are profile views of the embodiment of FIG. 3A being used to begin and complete a repetition of hip extension, respectively.

3A

FIG. 3A is a front oblique view of an illustrative embodiment 300 of the present invention. The embodiment shown 300 includes a base 302, a frame 304 attached to and supported by the base 302, a line-swiveling assembly 306 coupled with the base 302, a gripping device 308 connected to the frame 304, and a leaning space 310 that allows a user to lean their upper body for full range of exercise motion during any combination of hip extension and hip abduction, while under continuous resistance.

The important features of the present invention are highlighted in this graphically illustrative design 300. The combination of key structural elements and spatial relationships shown here can be rendered in many different possible embodiments. This embodiment 300 is shown mainly for illustrative purposes. It is a simple abstract representation of one of the most basic structurally feasible embodiments that supports a core functional objective of the invention. A "functional framework" for enabling this core objective is explicated further in connection with FIG. 3B, below.

The functional framework is a functional arrangement of key elements which enable a user to achieve full range of motion for any combination of hip extension and hip abduction, all from a single stance. The key elements and their relative position to each other make up the functional framework, which is present in this illustrative embodiment 300 and is analyzed in isolation in FIG. 3B. The functional framework can be manifest in many different structural designs, of which the embodiments shown, taught and described, in relation to FIGS. 6-14 are but a few possibilities.

The single stance from which a user can perform all manner of hip extension and hip abduction exercises is a central stance that substantially straddles the swivel axis 316. For the purposes of discussion of the present invention, a user can be said to be substantially "straddling" the swivel axis 316 if they are standing with substantially one leg on either side of the swivel axis 316. From this single stance, any combination of hip extension and hip abduction can be properly performed, with full range of motion.

It should be noted that for the purposes of this specification, a user can continue to straddle the swivel axis 316 even as their exercising leg is lifted off the base 302 and into the air. For a user to assume a stance that straddles the swivel axis 316, one leg must be on either side of the swivel axis 316. This is sustainable even while their exercising leg is in motion during hip extension and/or abduction. This stance (which can also be referred to as the "swivel straddle" stance) offers a variety of synergistic benefits (explored in greater detail in FIG. 3B) not found in the prior art.

In this embodiment, the gripping device 308 includes a plurality of grippable areas positioned along a substantially horizontal grip locus 312, extended here for illustrative purposes. The grip locus 312 is the locus passing through all grippable areas, terminating at the outermost grippable areas. It is shown here as a grip axis, positioned relative to the line-swiveling assembly 306 to allow a user to lean forward during exercise to properly stabilize themselves through any combination of hip extension and hip abduction movements. In other embodiments, the grip locus 312 can be angled or curved instead of a straight axis.

The plurality of grippable areas can comprise two grippable areas, one for each hand; or it can include more than two grippable areas. In the embodiment shown here, the gripping device 308 is a grippable bar and thus includes many different grippable areas, allowing for a variety of gripping configurations. For example, it is likely that a typical user is apt to discover that they desire a narrower grip for hip extension, versus a wider grip for hip abduction.

The line-swiveling assembly 306 is configured to engage with a resistance-transmitting line 314 to enable a pullable end of the line to swivel about a vertical swivel axis 316, allowing a user to pull the pullable end with an exercising leg to perform full range of motion for any combination of hip extension and hip abduction under resistance, from a single standing position that substantially straddles the swivel axis 316. In the embodiment shown, an inelastic weight-bearing resistance cable is being used.

The term "swivel" refers broadly to any movement of a pullable end of the line 314 from any one point on an arc 318 situated about the swivel axis, to any other point on the arc 318. While the pullable end may trace the arc 318, it need not trace the arc 318 continuously. A "swivel" is achieved whenever a movement of the pullable end results in the same state change as would have occurred if the pullable end had traced the arc 318 continuously.

A line-swiveling assembly 306 need not be a swiveling pulley in all instances, and one of ordinary skill in the art can readily appreciate that a resistance-transmitting line can be swiveled by other means. For example, in the case of a line that is an elastic resistance band, it can be connected to a D-ring which acts effectively as a swivel for the line. As another example, an elastic resistance band can be anchored at one end and guided through a series of parabolic blocks, one of which can serve as a swivel.

In this embodiment, the line-swiveling assembly 306 comprises a swiveling pulley that is free to swivel about a vertical swivel axis 316. Here, the pulley 306 is attached directly to the base 302, but can also be attached to the frame 304 or other connecting structure. The line 314 is fed into the swiveling pulley 306 substantially vertically and perpendicular to the initial direction of pulling, which is what enables its pullable end to swivel freely about the swivel axis 316.

The swiveling pulley shown 306 is able to swivel in a full circle about the swivel axis 316, thereby allowing the pullable end of the line 314 to swivel along a swivel arc 318 about the swivel axis 316. The unobtrusive pulley 306 guides the pullable end in a swivel arc 318 of considerably tight radius, ensuring that a user can accomplish all hip motions from a single stance that substantially straddles the swivel axis 316, and under continued resistance through their entire range of motion.

From the line-swiveling assembly 306, the resistance-transmitting line 314 is then guided across the frame 304. In the embodiment shown, the frame 304 includes a vertical support post 320 attached to the base 302, and a diagonal boom 322 attached to and supported by the support post 320. The line 314 is guided along the inside of the boom 322 by a resistance-activating pulley assembly, which in this case is a "weightlifting" pulley assembly comprised of a lower boom pulley 324 and an upper boom pulley 326, after which the line 314 then connects to weight 328.

In this embodiment, the resistance-transmitting line 314 is a weight machine cable configured to lift weight 328 in cooperation with a weightlifting pulley assembly 324, 326 coupled with the frame 304. In other embodiments, the line 314 can transmit resistance generated by other means, such as: via the stretching of an elastic band; or by the bending of a resistance rod (also known as a tension rod), for example. Still other resistance-generating elements may occur to one of ordinary skill in the art.

In the embodiment shown, the weight 328 to be lifted via the cable 314 is an exercise weight, specifically, a set of metal plates. In alternative embodiments, the liftable weight can include another object. For example, the liftable weight can be a container of water which can be filled to a selected level, to achieve desired weight and resistance. A metric on the container can indicate the weight produced by a given volume of water.

The weight 328 can be held steady by a stabilizing cable 330 that runs adjacent to the weightlifting cable's weighted portion 332 (the portion dropping vertically from the upper boom pulley 326 to the weight 328). As shown, the stabilizing cable 330 can be anchored at its top end to the upper end of the diagonal boom 322, and at its bottom end to the base 302. This stabilizing cable 330 prevents the weight 328 from swaying off its vertical axis, and thereby becoming destabilized.

In embodiments where the resistance-transmitting line 314 transmits resistance that is generated by an elastic resistance band of a flexible resistance rod, the elastic band can provide linear variable resistance, engaging the muscles with greater resistance as the muscle's own strength capacity increases. This can lead to increased benefits during gluteal exercise. Inclusion of elastic band and resistance rod is taught and described in greater detail below, in connection with FIGS. 13 and 14, respectively.

Unlike the restrictive designs of the prior art shown in FIGS. 1 and 2, the design of this line-swiveling assembly 306 provides a host of unique benefits during exercise. Due to the strategically low placement and small size of this swiveling pulley 306, a user is able to perform the full range of any combination of hip extension and hip abduction, all under continued resistance and from a single standing position that substantially straddles the swivel axis 316.

The swiveling pulley 306 of this embodiment is free to fully rotate in its horizontal plane, and also to tilt in its orientation. It is unobtrusive enough to enable a user to stand in close proximity to and straddle the swivel axis 316. While not exercising, the user can stand in a single neutral stance with no resistance applied. However, even a small displacement of the exercising leg for hip extension and/or abduction can generate resistance.

To emphasize, this versatile swiveling pulley 306 functions as an enhanced line-swiveling assembly, whereby the user is able to perform the full range of any combination of hip extension and hip abduction under continued resistance, while also returning to the same neutral stance at the end of a given set of leg motions. Such convenience is not made available by the line-swiveling assemblies of the prior art of FIG. 1 or FIG. 2.

In addition to enabling hip extension and hip abduction, the line-swiveling assembly 306 also can allow for nearly all degrees of flexion for anterior musculature strengthening that goes beyond enhancement of the gluteal muscles. And with every available motion, the neutral standing position itself encounters no resistance, yet a slight displacement in any direction immediately does yield resistance. This feature is optimal for exercise yet not available in conventional gluteal exercise machines.

Ease of exercise can be further enhanced by a lower extremity receiving device (hereinafter referred to as "LERD") 334 attached to the line's pullable end. In this embodiment, the LERD 334 includes a loop which can receive a user's foot during exercise. A horizontal opening along a distal portion of the loop can be secured around the user's heel during hip extension, while the loop in its entirety can wrap around the side of the user's foot during hip abduction.

Unlike the bulky pulley assembly (214) of FIG. 2, the customized pulley 306 of FIG. 3 can enable the LERD 334 to rest on the floor. The LERD 334 can include structural support that keeps it erect and poised to receive a user's foot, as shown, so that the user can step in and out with ease. This relieves the user from the need to manually engage or disengage the device with their foot, or to change their foot's orientation in the device by hand when changing up sets.

3B

FIG. 3B is a perspective view of a functional framework of the illustrative embodiment. The functional framework 338 is an isolated grouping of key elements of the illustrative embodiment, which together are responsible for enabling a core functional objective of the present invention. Specifically, the geometrical alignment, spatial relationship, and relative positioning of these elements enable a user to perform the full range of motion for any combination of hip extension and hip abduction, all while under continuous resistance, from a single standing location and with ideal posture.

The line-swiveling assembly 306 in this case is a swiveling pulley. It is configured to engage with the resistance-transmitting line 314 to enable its pullable end to swivel about the swivel axis 316. The swiveling pulley 306 itself is capable of swiveling in a full swivel circle 340. However, a user need not cross their leg in front of them to extend or abduct their hip. Therefore, the line 314 itself swivels through a swivel arc (see FIG. 3A) that is bounded at the user's "12-o'-clock" position, where the frame (not shown) itself extends to guide the line 314.

The gripping device 308 includes a plurality of grippable areas positioned along a substantially horizontal grip locus 312, where the grip locus 312 is positioned relative to the swivel axis 316 in a manner that allows a user to stabilize themselves in a "tripod posture" (formed by both arms and a standing leg) during any combination of hip extension and abduction, even when under considerable exercise resistance. In the embodiment shown, the grip locus 312 is a horizontal grip axis.

The grip locus 312 is the locus of points along which all grippable areas lie. It does not actually extend beyond the outermost grippable areas of the gripping device 308, but as it is depicted and labeled in FIGS. 3A and 3B, it is shown extending beyond the gripping device 308 solely for illustrative purposes. The grip locus 312 need not be a straight axis; it may be curved or bent. It can take any shape that would enable a user to perform full range of motion for any combination of hip extension and hip abduction with proper form.

In this embodiment, the gripping device 308 is a grippable bar positioned along a grip axis 312. This design enables a user to engage the gripping device 308 in a manner similar to a ballet bar. All hip and other lower body exercises that a ballet dancer might practice with such a bar would also be available to a user of this embodiment, with the extra benefit of added resistance for more intensely engaging gluteal and/or other lower body muscles.

The ballet bar 308 is one possible embodiment of the gripping device. In some embodiments, the gripping device may be a curved rail or a bent rail, while in other embodiments it may include a set of horizontal handlebars, or even a set of vertically oriented handles, for example. In each instance, the gripping device 308 is designed and positioned to allow a user to maintain tripod posture all throughout their exercise.

As defined herein, the user can be said to be in "tripod posture" if their standing leg is adjacent to the swivel pulley 306 and their hands spread sufficiently wide on the grip axis 312, to allow their torso to lean slightly opposite their lifting leg.

This positioning requires anterior-posterior separation 336 of the grip locus 312 from the swivel axis 316, to allow the user's the three stationary limbs to be widely separated (a theoretical tripod configuration). This confers maximal torso stability to resist the torque of the resistance on the lifting leg. This is an important departure from other machines.

The swivel-grip separation 336 is made more clearly visible in FIG. 3B by reference to a depth dimension indicator 342, which indicates the spatial relationship between the swiveling pulley 306 and gripping device 308. During exercise, a user must contribute a pulling force 344 that is equal and opposite to the force of resistance 346. The forces on either side of the swivel axis 316 must balance, and it is helpful for the user themselves to be balanced about the swivel axis 316. Since their lower body is posterior to the swivel axis 316, it is advantageous for their upper body to be anterior.

The key functional aspect of the gripping device 308 which allows the user to maintain tripod posture during any combination of hip extension and hip abduction under exercise resistance is its position relative to the line-swiveling assembly 306: the grip locus 312 is set apart 336 from the swivel axis 316. Decoupling 336 these two element alignments 312, 316 provides a far more efficient spatial arrangement for the exercise enthusiast than the prior art under consideration.

While on the one hand, the grip 312 must be in front of the user, on the other hand, the swivel 306 needs to be positioned at the user's feet, so that the force of resistance is perfectly opposite to and in line with the exercising leg's movement. If the swivel 306 was not placed at the feet but further forward instead, then leg movement during abduction would be complicated by a forward force vector of resistance. This would yield especial difficulty at the beginning of leg movement, when the proportion of the forward vector would be largest.

The horizontal displacement 336 of the grip locus 312 from the swivel axis 306 is made possible in part by an intermediate guiding pulley 324, which in FIG. 3A was referred to as a "lower boom pulley." This intermediate guiding pulley 324 occurs in other embodiments shown and discussed herein. This pulley 324 is integral to the functional framework 338. It enables the swiveling pulley 306 to swivel freely by guiding the line 314 on a right angle pathway about the swiveling pulley 306; but by also guiding the line 314 into yet another right angle about itself 324, it prevents the line 314 from obstructing the leaning space 310.

The intermediate guiding pulley as shown 324 is strategic in its position, being located above the line-swiveling assembly, but no higher than substantially the hip height of a user. But the intermediate guiding pulley 324 need not be located above the swiveling pulley 306 in order to accomplish its key functional objective. For example, in functional frameworks of alternative embodiments, it is possible for an intermediate guiding pulley to be located below the swiveling pulley 306, such as in the instance of a base thick enough to house a pulley. Such a pulley would still guide the line 314 on a right angle path about the swiveling pulley 306, but in that case, the line 314 would be directed downward, instead of upward (as shown here).

The intermediate guiding pulley 324 positioned at or below the user's hip height is a key feature of the functional framework 338 that sets it apart from much of the prior art. For example, in machine embodiments like the one shown in FIG. 2 where a user stands near a swiveling pulley, the design does not introduce an intermediate guiding pulley 324 at or below hip height, because such designs do not prioritize the goal of providing a user with optimal gluteal muscle targeting. Instead, they include a guiding pulley that is fixed at the top of a long vertical track, which enables the swiveling pulley itself to slide up or down the vertical track and be repositioned at will, depending on the desired exercise (ranging anywhere from shoulder to arm to leg exercise).

The lack of an intermediate guiding pulley 324 in universal or "garden variety" exercise machines (like that of FIG. 2) is a prime example of how a dedicated design, such as in the present invention, can set itself apart from designs having more general aims. Because the generic machine of FIG. 2 attempts to accommodate many different muscle groups, its design thereby sacrifices the specific goal of gluteal muscle exercise efficiency. Even more narrowly tailored machines still widely miss the mark, for example by failing to separate the grip and swivel axes, among other problems (see FIG. 1).

In the embodiment shown, the grip locus 312 is substantially at least forearm length 336 from the swivel axis 316, thereby enabling strong tripod posture. In other embodiments, the grip locus 312 can be closer to the swivel axis 316, such as hand length, for example. Also, in some preferred embodiments, the gripping device 308 can be substantially at least hip height above the floor and/or its grippable areas span substantially at least shoulders width, as is the case in FIG. 3B.

The grip locus 312 must span the proper width. The grip locus 312 is defined herein as the locus of points along which all grippable areas lie, and as such, it does not actually extend beyond the outermost grippable areas of the gripping device 308. To be sure, the grip locus 312 as depicted and labeled in FIGS. 3A and 3B is shown extending beyond the gripping device 308 for illustrative purposes; however, the true grip locus 312 is coextensive with the gripping device 308, and it terminates where the gripping device 308 itself terminates.

Proper positioning and extension of the grip locus 312 requires that its extent be wide enough to allow a user to properly perform full range of motion during hip extension and/or abduction. Therefore, in addition to the gripping device 308 being separated from the swivel axis 316, the span of the gripping device 308 must extend away from the swivel axis 316 far enough in both directions as to enable a user to comfortably and effectively stabilize themselves throughout the full motion of these hip exercises.

To underscore this point, the current invention necessarily requires the gripping device 308 be extensive enough to provide grippable areas that allow a user to assume a sufficiently wide grip, to enable them to perform even straight hip abduction with full range of motion (which requires wider grip than does hip extension). This requirement rules out the narrow grip loci of the prior art of FIGS. 1 and 2, as those grip loci would not enable the user to properly counter the significant torque that occurs particularly during leg movement comprised largely of hip abduction.

Part and parcel to the benefit conferred by the swivel-grip separation 336 is the presence of the leaning space 310 that allows a user to lean their upper body forward and take full advantage of the swivel-grip separation 336, as well as the enhanced stability it affords. As the user lifts their exercising leg, it is natural for the user to wish to lean forward to help them balance their lower body's movement with a counterforce from their upper body. This ideal posture is made possible by the synergistic effect of the combination of the leaning space 310 and swivel-grip separation 336.

Due to the harmony of these relationships, a user is able to comfortably perform any combination of hip extension and abduction from a central standing position that substantially straddles the swivel axis 316. The strategically small swiveling pulley 306, with its tight swivel radius 340, provides the clearance to enable the user to stand in this central position. By straddling the swivel axis 316, the user is able to overcome the tension of the line 314 with a perfectly opposing force from their exercising leg, as well as deftly balance their upper body by leaning in the direction perfectly opposite their exercising leg.

Such a precise counterpoise of force vectors, with no tangential forces disrupting any of the user's exercise movements, is only possible when the user avails themselves of this special "swivel straddle" stance. If the user were not straddling the swivel axis 316, they would experience at least some orthogonal force vector disturbing the arc of their leg's movement, and/or they would be compelled to supply at least some twisting and/or torsion of their body to maintain balance. Furthermore, they would have to shuffle their feet to change direction of leg movement and/or to abduct their opposite leg.

All benefits of the swivel straddle stance converge on a common theme: unparalleled efficiency in isolating one's gluteal musculature. From this stance, a user is able to lean into tripod posture and focus the full force of resistance 346 on their gluteal muscles without having to apply torque from any part of their body. The stance also relieves the user of the need to reposition their footing or change their body's orientation for different leg motions, or when switching their exercising leg. And when the user returns their leg to the upright standing position between sets, the line 314 returns to its neutral resting state: thus, freed from any persistent force of resistance 346, their leg can also come to rest.

By enabling this swivel straddle stance, the swivel-grip separation 336 and leaning space 310 work naturally together to promote the user's best posture during gluteal exercise. This enables the user to exercise their gluteal muscles in an efficient and comfortable manner, making the process safer, healthier and more enjoyable. It also promotes superior gluteal muscle building due not only to a greater range of motion, but also to a greater strength capacity of the body when exercising in its normal, healthy and anatomically preferable bearing.

The embodiment shown offers superior gluteal muscle targeting by enabling a user to execute various leg motions that simultaneously comprise both partial hip extension and partial hip abduction. As just one example, studies indicate that a 45 degree lateral leg movement comprised of half hip extension, half hip abduction, which works the gluteus maximus along the orientation of its fibers, yields optimal results.

This embodiment and other embodiments discussed below can also enable a user to perform hip rotation, adduction, and even flexion, enhancing their lower body workout even further. In addition to allowing more leg movement options with better form, it also allows for change in the trajectory and/or orientation of the leg within a given repetition, even enabling such movements as kicks or sweeps. All this can be achieved from a single convenient standing position.

The prior art surveyed in FIGS. 1 and 2 represent various limitations of current machines. The elements and features discussed in FIG. 3B combine to provide a unique and unexpected synergistic effect over the prior art. Strategic design and relative placement of a line-swiveling assembly 306 and gripping device 308, coupled with ample leaning space 310 to allow for tripod posture, serve to provide the user with unmatched efficiency and comfort.

3C

FIG. 3C is a profile view of the grip-swivel portion of the illustrative embodiment as shown and described in FIG. 3A alongside a hypothetical grip-swivel portion of a multipurpose exercise machine. Juxtaposing the respective key portions these two machines can help to highlight some key benefits of embodiments of the invention, and the underlying functional framework on which they are designed, discussed in FIG. 3B.

The illustrative grip-swivel portion 348 reveals an ideal offset of various key elements, relative to the user's standing position for exercise. Firstly, the illustrative portion 348 enables the LERD 334 to stand level due to the small profile of the swiveling pulley 306. This provides the user with the convenience of being able to easily stand and come to rest between leg exercise movements, and just as easily resume exercise, defined previously as 'resting neutral'.

In the illustrative portion 348 it can also be seen that the user is always able to stand adjacent to the swiveling pulley 306 and in close proximity to it, thereby effectively straddling the swivel axis 316 during all gluteal exercise. This is another benefit of the small profile of the swiveling pulley 306 and its tight swivel radius. It is a fundamental ingredient to being able to assume and maintain tripod posture throughout all exercise.

Finally, the intermediate guiding pulley 324 unlocks the full potential of the functional framework of this illustrative portion 348. By diverting the resistance-transmitting line 314 off the vertical swivel axis 316, the user can avail themselves of a vast leaning space 310 and a grip 308 that is significantly offset from the swivel axis 316 and the location of their stance. This arrangement allows for continual tripod posture.

A user is in tripod posture when their standing leg is adjacent to the swiveling pulley 306, and their hands are spread sufficiently wide on the gripping device 308 to allow their torso to lean slightly opposite their lifting leg. Hip abduction in tripod posture is enabled as the user extends their arms through the swivel axis 316 to widely grasp the grip axis, as the lifting leg begins its range with the foot in resting neutral directly adjacent to the small swivel pulley 306.

As resistance is engaged, the leg is able to abduct with the resistance in line with the pull of the gluteus medius and minimus. To counter the torque of lift off, the lifting side arm and shoulder can brace against the bar, and the upper torso can lean slightly away from the lifting side, all to effect maximal weight load and gluteal abductor work. Hip extension is maximally enabled by the user's ability to also lean their torso through the swivel axis 316, and even over the grip axis.

This shift of posture over the grip axis allows benefits that are two-fold. First, the counter balance of the upper torso opposite the resistance on the lifting leg allows the user to lift considerably more weight, and therefore insures more gluteus maximus work. Secondly, and perhaps even more importantly, by leaning forward, over the grip axis, while the stationary leg remains planted adjacent to the swivel pulley, the pelvis is rotated forward simultaneously.

The resultant increase in hip range of motion allowed by this leaning posture increases the range of hip range of motion during each lifting leg set approximately two-fold, therefore increasing the volume of gluteal muscles enlisted, therefore ensuring faster gluteal development.

The portion shown of the multipurpose exercise machine 350, in sharp contrast, reveals fundamental limitations when used specifically for gluteal exercise. This machine enables a pulley support 354 to be slid up and down a vertical track 356, to be locked into the desired vertical height for a multipurpose range of exercise that includes the upper extremities. As such, the design is not optimal for gluteal work specifically.

Although ingenious in its design, the terminal pulley pair 352 which allows for both high and low use, comprise a rather bulky unit. The combination of the pulley pair 352 and the pulley support 354 combine to be problematic with use for gluteal exercise. The pulleys and their support cannot be lowered to ground level, adjacent to the standing foot. The lowest setting leaves the cable attachment to the LERD 334 elevated to an extent that it does not enable the LERD to sit flat for convenient resting during use.

The bulkiness of this swiveling pulley 352 also prevents the user from effectively straddling the swivel axis 362 through all leg exercises. The large swivel radius of the pulley complex 352 demands that the user shuffle about the swivel circumference when varying their exercise and/or exercising leg. As a corollary to this problem, the user will be displaced from any particular potential gripping locus, as they shuffle their position.

Finally, with no intermediate guiding pulley but only a top pulley 364 at the top of the vertical track 356, this machine affords the user little leaning space 360, which does not even extend up to the swivel axis 362, much less beyond it. Thus not only is it impossible for the user to routinely straddle the swivel axis 362, but they also have no chance of effecting tripod posture for any of their leg exercises.

A hypothetical gripping device 370 is shown, representing the same swivel-grip separation 336 as occurs naturally in the illustrative design 348. Such grip 370 would clearly not be accessible to a user, given the obstructions in the way that include both the resistance line 358, and also the vertical pulley track 356. Prior art, as illustrated in FIG. 2, has included attempts to add gripping handles to the multipurpose machine.

Unfortunately, for the reasons described above, the handles do not allow for full spectrum or optimal gluteal work. Primarily, they have to be placed at the swivel axis, rather than a forearm's length behind the swivel axis. Again, it would be impossible to place the grip axis behind the swivel axis 370, because the resistance line 358, and also the vertical pulley track 356 would prevent the necessary leaning space.

As shown in FIG. 2, the user of a multipurpose machine with handles when performing extension, must stand a forearm's length back from the swivel axis, rather than straddling the swivel axis as is done with this invention. This backward stance, away from the swivel axis, prevents a resting neutral stance, which requires the user to shuffle back to begin the reps, then shuffle forward to unload the resistance at the completion of an exercise set.

For abduction exercise, a user of a multipurpose machine would commonly turn 90 degrees to the machine to align the resistance with the gluteus medius and minimus muscle fibers. Should the user attempt to remain facing the machine, stabilizing the torso with the supplied handles in a backward stance, an anterior force vector contaminates pure abduction, and limits maximal weight recruitment.

Resting neutral, again, cannot be achieved. If the user attempts to stand straddling the swivel pulley, the width of the bulky pulley pair have already usurped one third of the potential exercise range as the user must begin in a widely spread stance. And in this position, a comfortable and stable tripod type stance is not possible, the stationary limbs are all residing in the same plane.

The side by side comparison illuminates the advantages provided by this invention. The ability to stand adjacent to a small ground level swivel pulley, while assuming a tripod posture, widely gripping a wide grip axis that resides far forward of the swivel axis, allows both a stabilized starting posture for a full range of extension thru abduction, but also a comfortable resting neutral start and finish to each repetition.

The user has the luxury, from this comfortable starting position, tripod stance, to begin any leg exercise trajectory of his choosing, provided the LERD is so designed to be hands free, he can, at the completion of a repetition, even switch to the opposite leg while remaining in this comfortable, resting neutral, resistance free stance.

A leaning space, provided by the intermediate guide pulley diverting the resistance line away from the space above the grip axis, enables the user to comfortably lean towards, even over, the grip axis, which avails the user a more powerful and much wider hip range of extension. All these advantages provide the user with maximal gluteal exercise work that can target specific gluteal musculature in the most efficient fashion.

FIGS. 4A and 4B are front oblique views of the embodiment of FIG. 3A being used to perform hip extension and hip abduction, respectively. This pair of images graphically illustrates the importance of hip abduction as a supplement to hip extension, for the purpose of attaining a fully sculpted and shapely buttock contour, as well as maximally strengthening the gluteal musculature and thereby also the body's core.

FIG. 4A is a front oblique view of the embodiment of FIG. 3 being used to perform hip extension. Hip extension is an efficient movement for exercising the largest gluteal muscle, the gluteus maximus. A user 400 leans to shift their weight forward and assume tripod posture with both arms 402 and their standing leg 404, as they fully extend their exercising leg 406 back. As a result, the gluteus maximus 408 of the exercising leg 406 is engaged.

The LERD 334 includes a loop into which a user can step to insert their foot. A horizontal opening along a distal portion of the loop receives the user's heel, enabling the LERD 334 to remain securely attached around their foot and ankle during leg motion primarily involving hip extension. In this capacity the LERD 334 enables full range of hip extension, without restricting the user's natural tendency to point their toes downward.

Despite the benefits of hip extension, this motion does not exercise the gluteus maximus 408 along the precise orientation of its fibers, nor does it even engage all of the gluteal muscles (in particular, the gluteus medius and gluteus minimus are not significantly targeted during "pure" hip extension, that is: hip extension that is not at all accompanied by hip abduction). At least some hip abduction (plus external rotation of the hip) is needed to fully activate the gluteus maximus 408, and indeed substantial hip abduction is required to activate the gluteus medius and minimus muscles.

FIG. 4B is a front oblique view of the embodiment of FIG. 3 being used to perform hip abduction. The ability to abduct the hip is indispensible in developing one's gluteal musculature. Straight abduction (as shown here) works the gluteus medius and minimus muscles 410, thereby leading to more balanced buttock strengthening and development, and more well-rounded appearance. Strategically combining hip extension with hip abduction can exercise all gluteal muscles 408, 410 with maximum efficiency.

For predominantly abducting the hip, the user can insert their foot partially into the LERD 334 so the entire distal portion of its loop wraps around the outside of their foot (rather than surrounding the heel, as in FIG. 4A), shown in FIG. 4B. This technique helps to support more of the user's outer foot during hip abduction, than in the case of leg motion comprised predominantly of hip extension, where the lower leg can more easily absorb the majority of the force of resistance transmitted from the line 314.

The versatile design of the LERD 334 provides a secure central attachment to the exercising foot during any combination of hip extension and hip abduction—even abduction that includes external hip rotation (which is particularly beneficial to gluteal maximus strengthening). The central attachment enables the line 314 to be guided perpendicularly away from the orientation of the foot of the abducting leg, without in any way interfering with proper form for hip abduction exercise.

The prior art of FIGS. 1 and 2 cannot enable straight hip abduction. By contrast, the design of the present invention greatly facilitates proper form for hip abduction. Unlike in FIG. 2, here the user can lean forward and assume stable tripod posture with a wide grip 402 near pelvis height, thus avoiding the strain of torsion or arching of their back. Furthermore, here the LERD 334 enables the user to abduct their hip without the lateral force from the line 314 pulling the front of their foot inward, as occurs in FIG. 1.

FIGS. 4A and 4B illustrate the wide variety of hip and leg motion that can be executed safely and with proper form under resistance, when using the invention. Hip extension as shown in FIG. 4A, hip abduction as shown in FIG. 4B, and/or any combination thereof, can be performed with proper balance and optimal body mechanics. This versatility is due to the user's tripod posture, enabled by the horizontal spatial separation 336 between the grip bar 308 and the swiveling pulley 306, and by the leaning space 310 above the frame.

The term "tripod" underscores the enhanced stability of this specific posture that is produced by the user's two arms and their standing leg during exercise. Its execution depends on the swivel-grip separation 336. If the grip locus was not separated 336 anteriorly from the swivel axis, then the user's grip would not be anterior to their standing leg, and thus they would not be leaning forward and/or downward with their grip. In that case, they would not be likely to be maintaining tripod posture during exercise.

Tripod posture further enables a user to lean away from their exercising leg to enable it to exert its full range of motion, thereby activating their gluteal muscles to the greatest extent. It also distributes the user's mass more evenly, thereby providing superior balance. Finally, by enabling the user to appropriately tilt their torso and shift more weight to their shoulders, it minimizes the potential strain on their lower back.

By allowing a user to work their gluteal muscles with superior efficiency and comfort, the present invention enables a user to lift more weight and perform more assertive movements than other forms of gluteal exercise generally allow. Furthermore, the ergonomic form and posture supported by the present invention facilitates gluteal exercise through straight-legged hip extension and hip abduction movements, thereby minimizing joint strain as well.

This enhanced efficiency of movements is only possible because the user 400 is able to stand in a central position that substantially straddles the swivel axis. FIGS. 4A & 4B highlight well the versatility of this swivel straddle stance. As the user 400 exercises, they can extend and/or abduct either exercising leg 406 directly outward from the swiveling pulley 306 in whichever direction they wish, with no force vectors pulling them off course and no need to apply torque with their body. In addition, the user 400 can change up their exercise motion without having to alter their standing position, and without having to contend with resistance from the line 314 while resting in that standing position.

As demonstrated, the functional framework explored in FIG. 3B is integral to the benefits described here. The key functional elements, arranged in accordance with the parameters laid out in this discussion, provide the user with a superior experience and superior results. And while other embodiments may include variations on certain structural elements, such as the configuration of their structural frame or the nature of their resistance-generating element, they nonetheless employ this same familiar functional framework.

5

FIG. 5A is a profile view of the embodiment of FIG. 3 being used to begin hip extension. Even at this early stage, the advantage of the present invention over the prior art can be seen. The user 400 begins to lean their head 500 and torso forward into the leaning space 310, which enables them to shoulder their upper body weight via their grip, thus eliminating the need to keep their back erect during the raising of their exercising leg 406.

FIG. 5B is a profile view of the embodiment of FIG. 3 being used to complete hip extension. Here, the advantage over the prior art is dramatically illustrated and even more apparent than in FIG. 5A. The user 400 is shown leaning far forward in full tripod posture, with their head 500 now positioned well over the grip bar 308. They are able to fully support their upper body with their arms 402 as they lean forward and extend their hip to maximum capacity, all the while avoiding awkward arching of the back.

While the prior art of FIGS. 1 and 2 do not facilitate proper form for hip extension, the design of the present invention induces proper form and empowers the user to extend their hip to its fullest extent. The user 400 can lean forward and support their torso's weight with their grip 308 at pelvis height, avoiding strain from back arching. Furthermore, the LERD 334 does not restrict the downward orientation of their foot, which is critical in enabling the user 400 to extend their hip fully.

FIG. 5B underscores one of the fundamental reasons why the present invention offers such advantage over the prior art during hip extension. A user of the prior art shown in FIG. 1 could not assume tripod posture, nor would their foot be able to point down without difficulty. On the other hand, a user of FIG. 2 could not lean beyond the swivel axis to fully make use of the available motion in the Sagittal plane, and would sacrifice close to half their potential range of motion.

To emphasize this point, leaning forward during hip extension induces a user 400 to work their gluteus maximus 408 through a range of motion that is far more extensive than the range of motion for a user who cannot lean forward. This is due to the anatomical limit of how far a user can extend their leg 406 back relative to their pelvis. When a user 400 leans forward, they tilt their pelvis in a manner that effectively doubles the available range of motion of their exercising leg 406 during hip extension.

Considering the structural design of the prior art of FIG. 2, it would not be possible for a user of that machine to extend their leg back nearly as far as the user in FIG. 5B, due to the lack of a leaning space, and the higher position of its handles. Even the prior art of FIG. 1 cannot allow for the same range of hip extension as shown in FIG. 5B, owing to the restrictive influence of its customized shoe and the poor stability afforded by its narrow grip, as well as the limited length of its cable.

In preferred embodiments, the leaning space 310 extends through the swivel axis and over the gripping device 308. This enables the user 400 to lean far forward, even in front of and above the grip locus where the user's hands are stabilizing them. In alternative embodiments, the leaning space 310 may terminate at the vertical axis of the grip locus, but for optimal leaning capacity, the leaning space 310 can extend over and even beyond the gripping device 308.

In FIGS. 4 and 5, the horizontal displacement of the line-swiveling assembly 306 from the gripping device 308 is the unsung hero in the exercise techniques shown. Separation (see FIGS. 3A and 3B, element 336) between the grip locus and the swivel axis enables all beneficial features of the invention to harmonize and produce their synergistic effect for the user: tripod posture, forward leaning, full range of motion, and maximum muscle activation.

Exemplary Machine Embodiments

Figure 6:
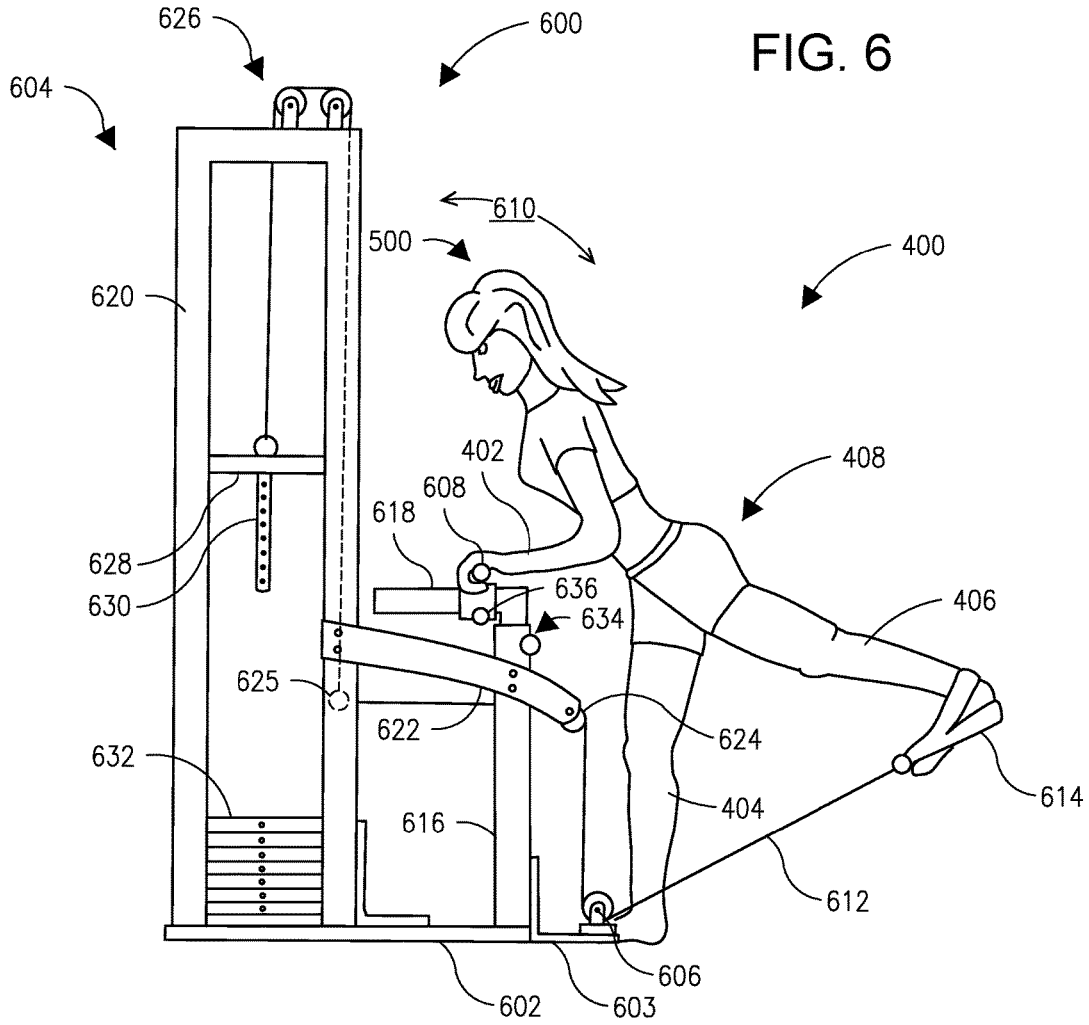
Figure 9:
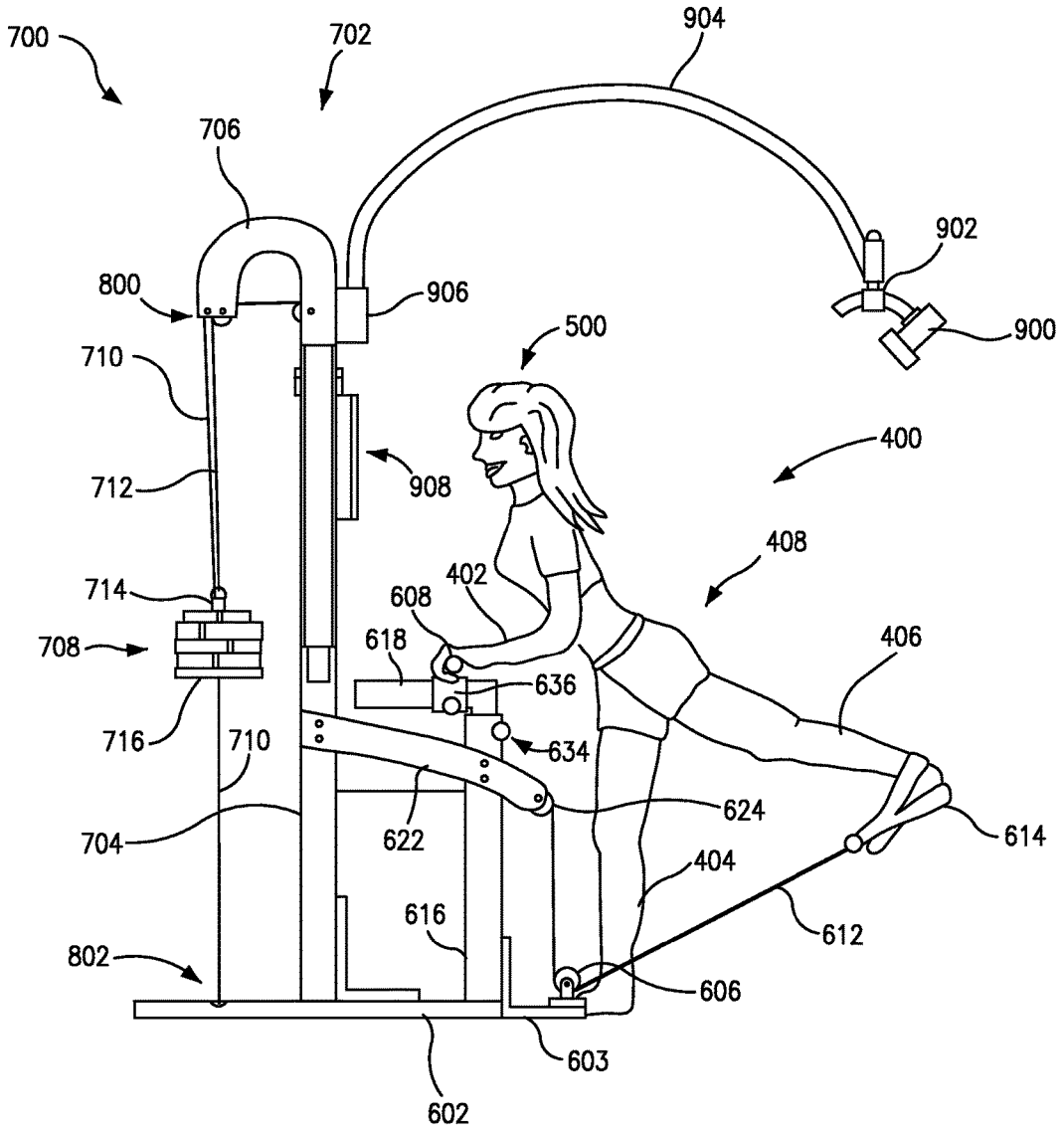
Figure 10:
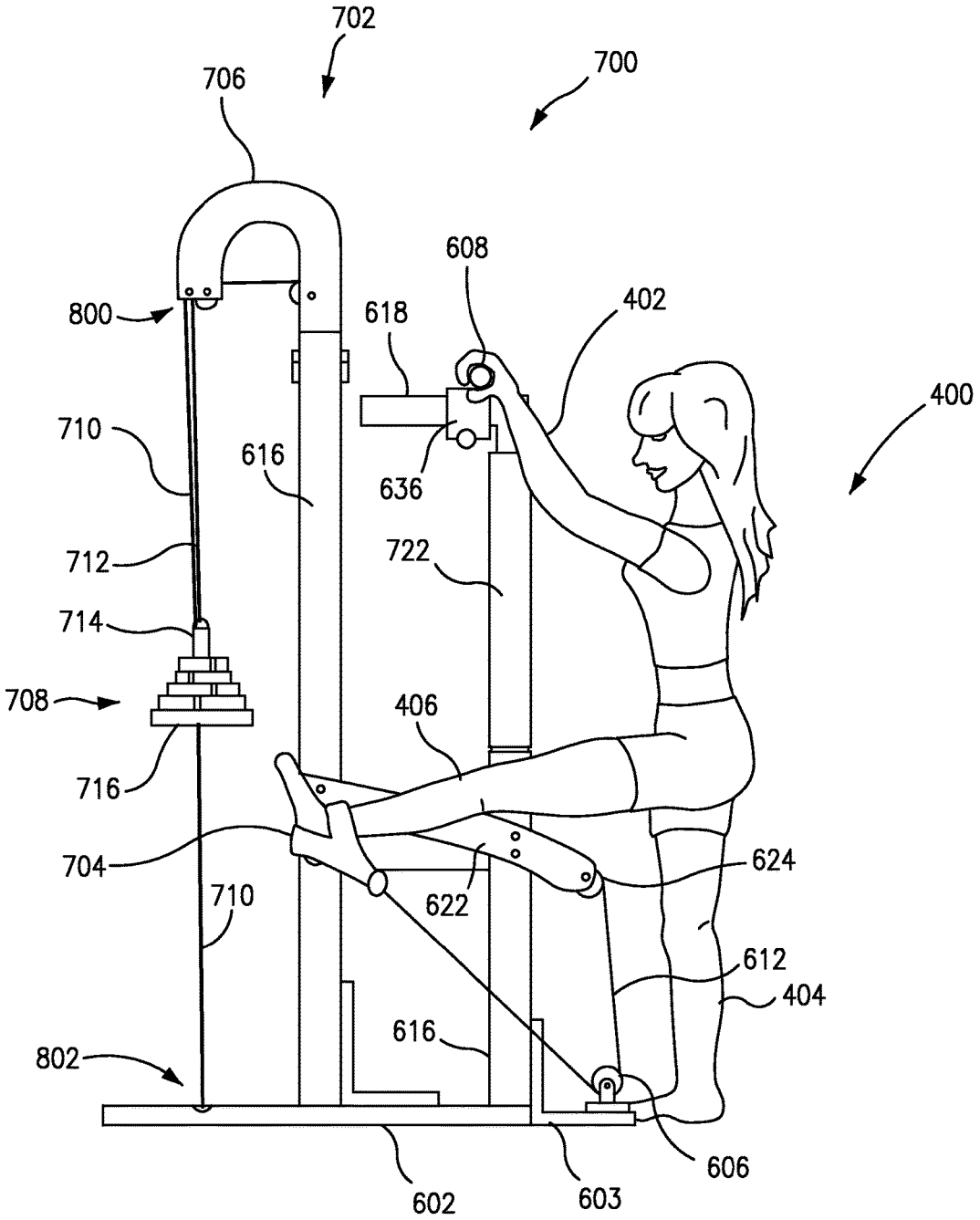
Figure 11:
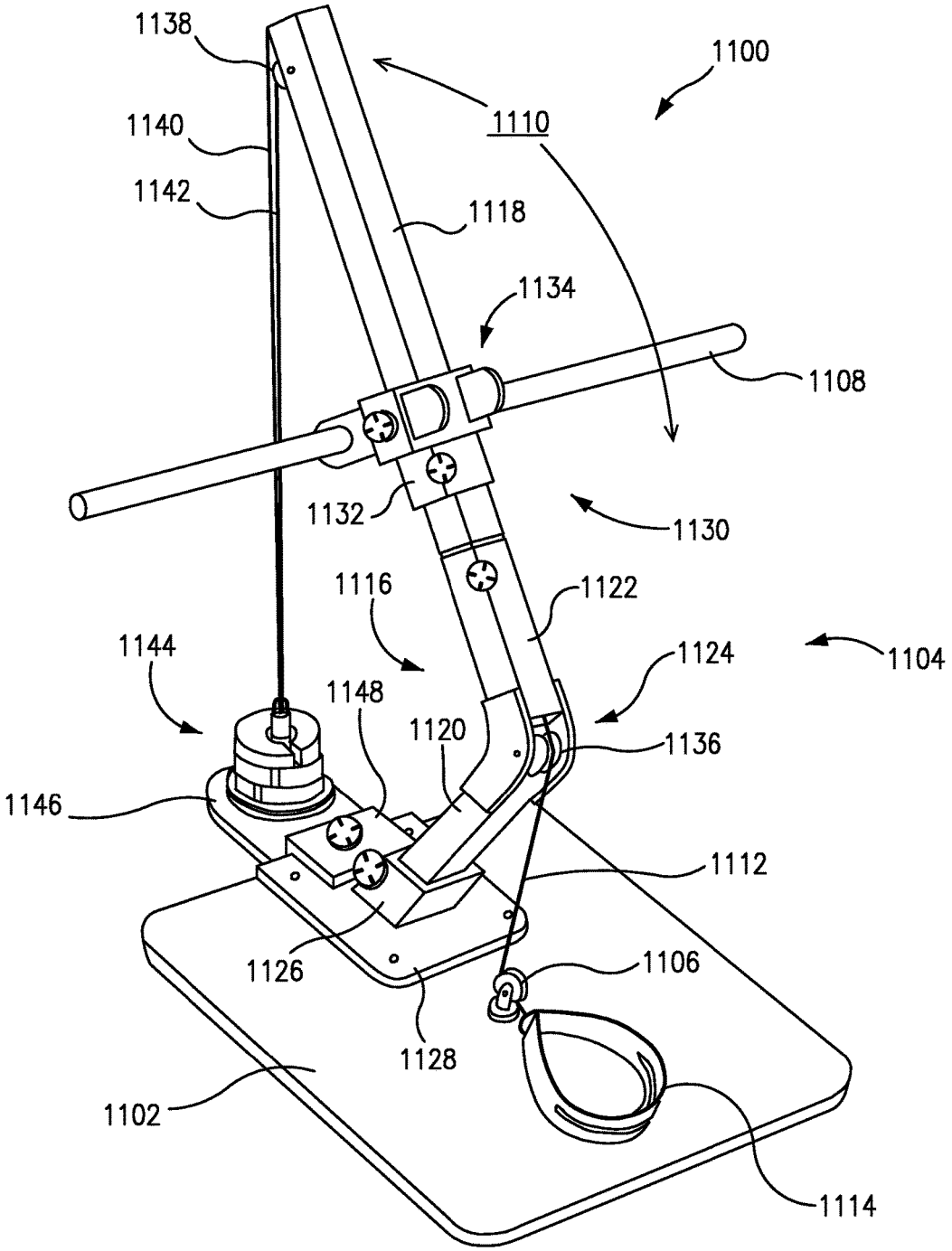
Figure 12A:
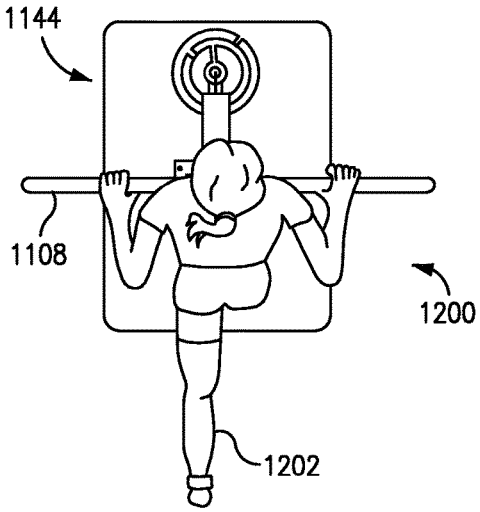
FIG. 12A is a top view of the embodiment of FIG. 11 being used to perform hip extension.
Figure 12B:
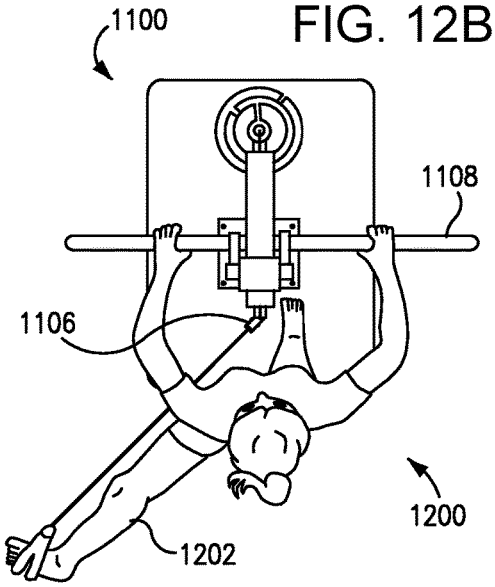
FIG. 12B is a top view of the embodiment of FIG. 11 being used to perform simultaneous hip extension and abduction.
Figure 12C:
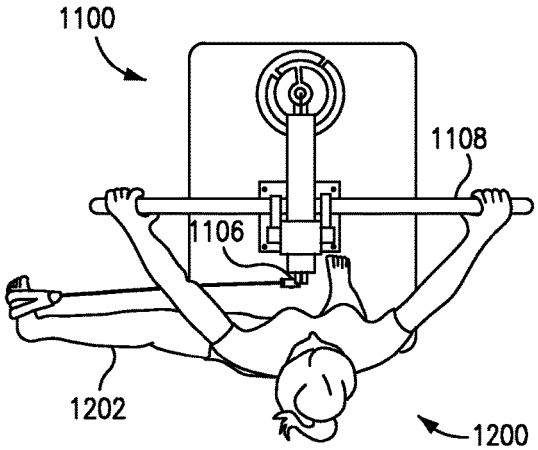
FIG. 12C is a top view of the embodiment of FIG. 11 being used to perform pure hip abduction.
Figure 12D:
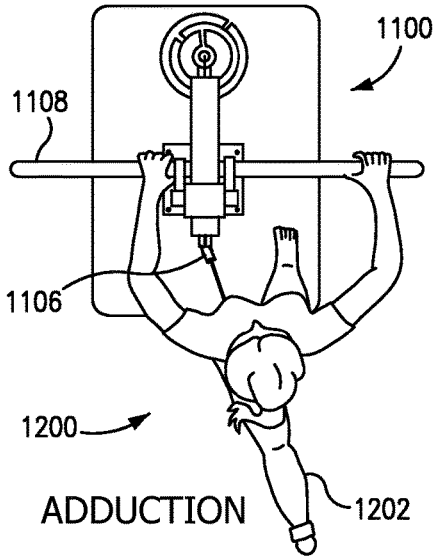
FIG. 12D is a top view of the embodiment of FIG. 11 being used to perform hip adduction.
Figure 13:
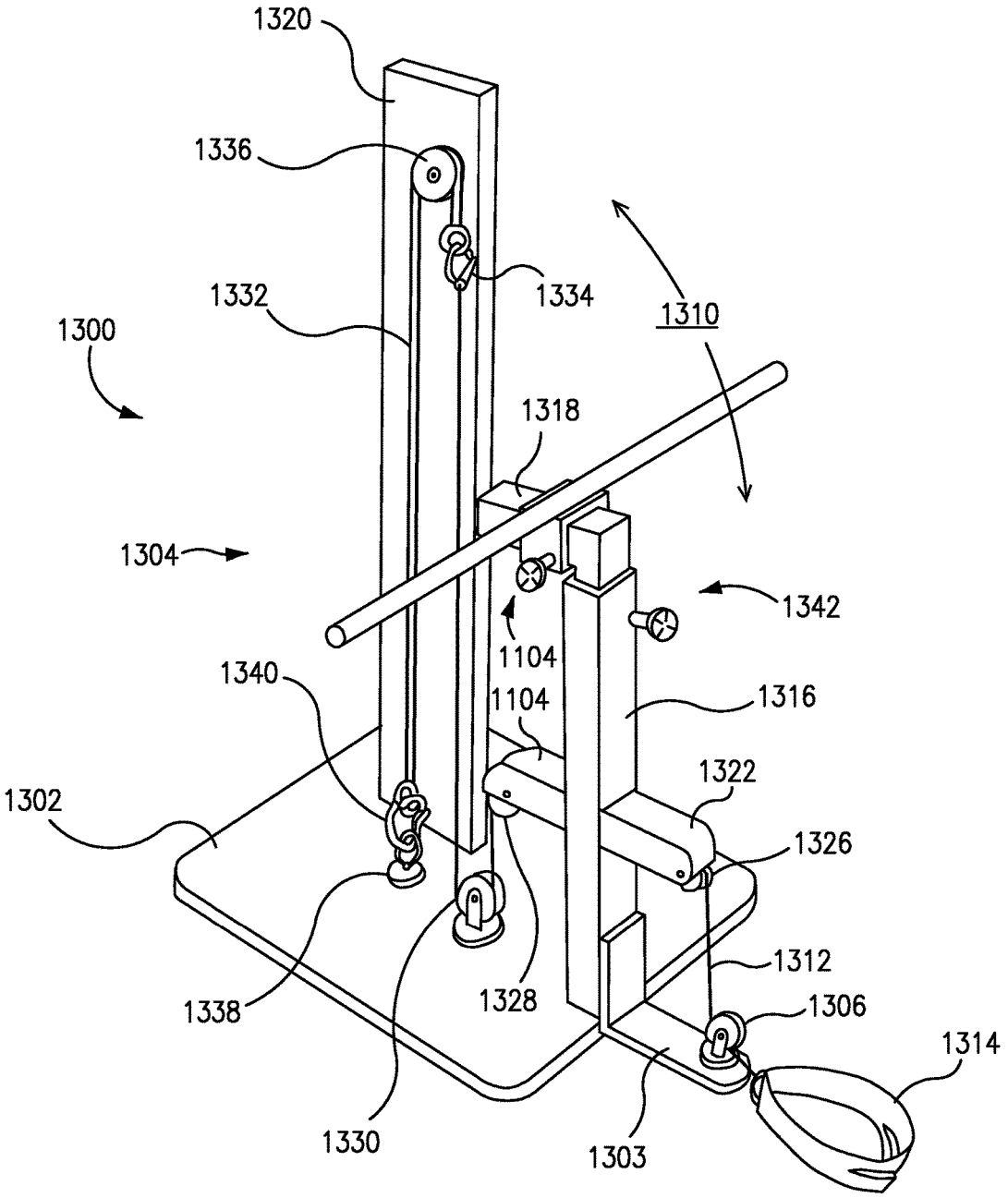
Figure 14:
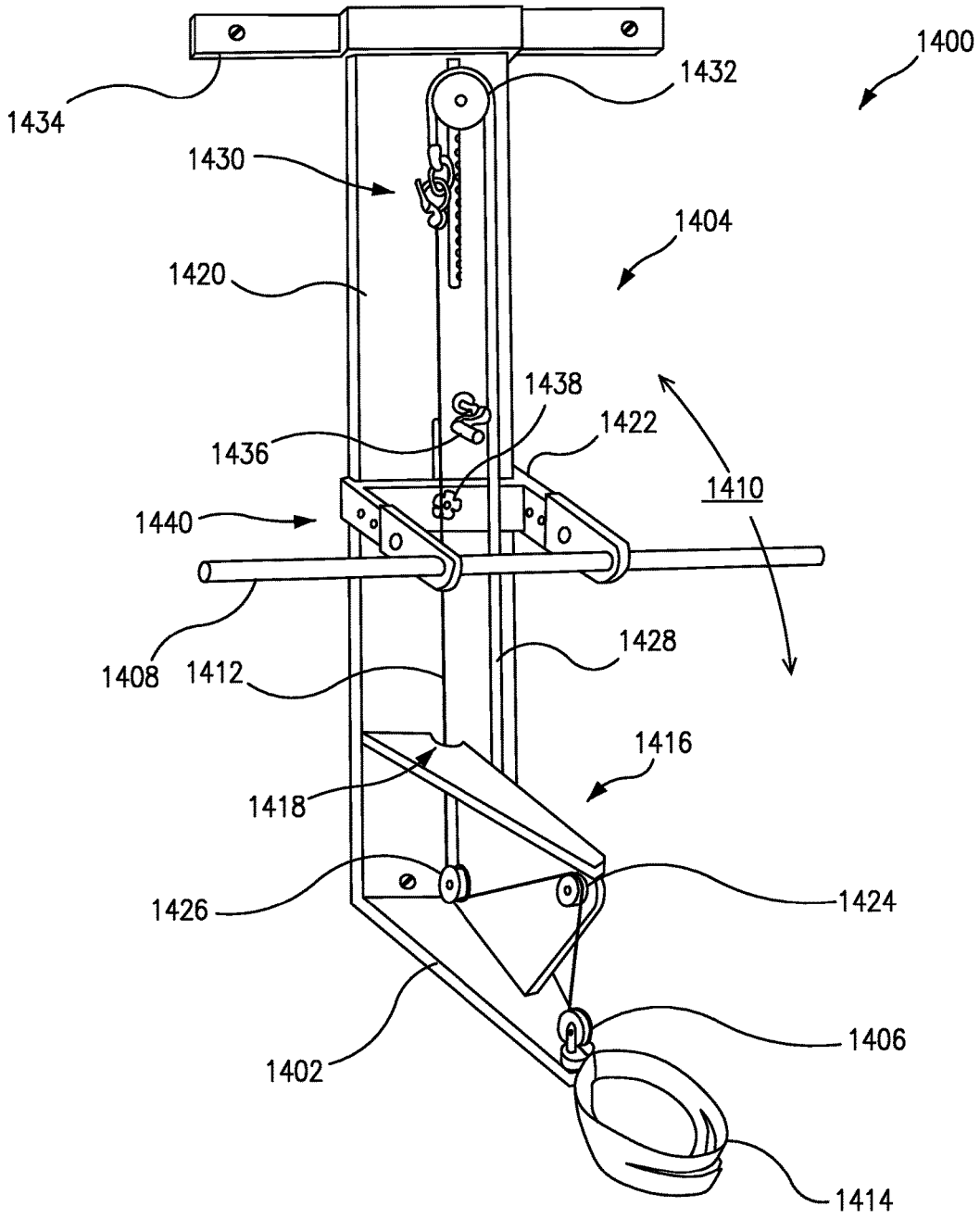
Figure 15:
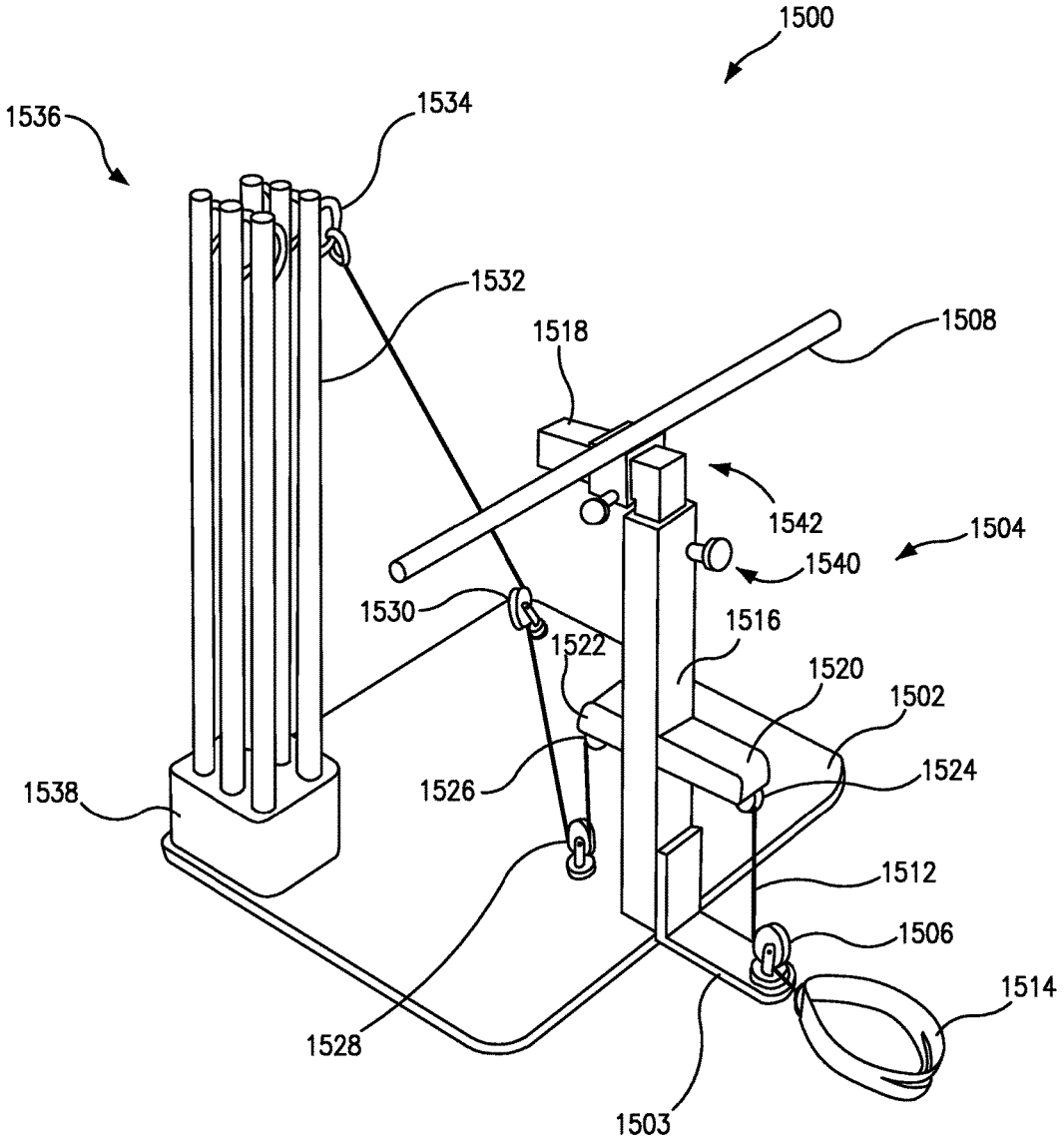

FIGS. 6-15 show exemplary machine embodiments of the invention, specifically: FIG. 6 is a profile view of a weightlifting machine with a conventional weight stack; FIG. 7 through FIG. 10 include views of a weightlifting machine with an open-ended frame; FIGS. 11 and 12 include views of a streamlined design embodiment; FIG. 13 is an oblique view of an embodiment that generates resistance via stretching of an elastic band; FIG. 14 is an oblique view of a wall-mountable embodiment using an elastic band; and FIG. 15 is an oblique view of an embodiment that generates resistance via bending of a flexible rod.

6

FIG. 6 is a profile view of a possible commercial embodiment 600 of the invention, again being used to perform full hip extension. As above, this embodiment 600 includes a base 602, a frame 604 attached to and supported by the base 602, a line-swiveling assembly 606 coupled with the base 602 (via a metal tongue 603), a gripping device 608 connected to the frame 604, and a leaning space 610 that allows the user 400 to lean their upper body for full range of exercise motion during any combination of hip extension and hip abduction under resistance.

While certain elements shown here (such as the frame 604, for example) are unique to this embodiment 600, the same functional framework of FIG. 3B is present, and achieving the same benefits here as previously discussed. The structural variations of this embodiment 600 therefore do not depart from the essence of the inventive concept. Instead, those variations commingle with and enhance the effectiveness of the functional framework, thereby asserting and demonstrating its value even more clearly.

As with the earlier illustrative embodiment 300, in FIG. 6 the line-swiveling assembly 606 is a swiveling pulley configured to engage with a resistance-transmitting line 612 to enable a pullable end of the line 612 to swivel about a vertical swivel axis, thereby allowing the user 400 to pull the pullable end with an exercising leg 406 (via a lower extremity receiving device 614, or "LERD"), to perform full range of motion for any combination of hip extension and hip abduction under resistance from a single standing position. Here, an inelastic weight-bearing resistance cable 612 is being used.

From the line-swiveling assembly 606, the resistance-transmitting line 612 is guided across the frame 604 along a pathway that is laid out by a series of pulleys, discussed below. The frame 604 itself includes: a vertical support post 616 attached to the base 602; a grip support bar 618 coupled with the vertical support post 616; a conventional weight-lifting frame 620 attached to the base; and a crossbar line guide 622, connecting the vertical support post 616 to the weightlifting frame 620.

The line 612 is guided across the frame 604 via pulleys in the following manner. First, the line 612 is guided vertically upward from the swiveling pulley 606 to a strategically placed guiding pulley 624 located at the distal end of the crossbar line guide 622. Then, the line 612 is guided horizontally to an internal frame pulley 625, and then vertically upwards along the inside of the weightlifting frame 620 to a pair of top frame pulleys 626. All these pulleys 624, 625, 626 function together as a resistance-activating pulley assembly, which in this case is a weight-lifting pulley assembly.

The line 612 then connects to a liftable bar 628, already known in the art of weight machines. The liftable bar 628 includes a vertically oriented rack 630 with holes that are adapted to receive a locking pin. A stack of metal plates 632 rests at the bottom of the weightlifting frame's 620 interior, each plate capable of being locked to the vertical rack 630. As in conventional machines, movement of the weight bar 628 and metal plates 632 can be guided by vertical tracks inside the weightlifting frame 620.

Since the weight stack 632 shown here is stabilized by the weightlifting frame 620 itself in this system, a user can change the weight of resistance by operating the pin rather than manually placing plates on a tray. Because the exercising leg 406 functions as a long lever arm, even small incremental changes in weight can effect considerable change in resistance to the gluteal muscles. It is therefore advantageous for the individual metal plates 632 to be of relatively little weight increment.

Various components of the frame 604 may be adjustable. In this embodiment, the position of the gripping device 608 can be adjusted in the vertical and horizontal dimensions within the user's Sagittal plane. Here, the height of the gripping device 608 is controlled by a grip height adjustment system 634 that extends the vertical support post 616 up and down, while a swivel-grip displacement adjustment system 636 controls the position of the gripping device 608 horizontally along the grip support bar 618.

The height of the gripping device 608 can be adjusted to accommodate users of different heights. The swivel-grip displacement adjustment system 636 can be used to increase or decrease the displacement between the grip locus of the gripping device 608 and the swivel axis of the swiveling pulley 606, and the nearness of the gripping device 608 to the user 400. Both of these adjustment systems 634, 636 can be manipulated by the user to secure the optimal position of the gripping device 608 relative to the swiveling pulley 606, to effect the best posture for a given exercise.

Another noteworthy feature of this frame 604 is the large amount of leaning space 610 afforded by its design. In this embodiment 600, the leaning space 610 is not bound by a hypotenuse such as a diagonal boom frame element. Furthermore, rather than the grip locus 608 being fixed in one position, its vertical and horizontal coordinates can be adjusted independently. This adjustability of the position of the gripping device 608 further enhances the user's 400 freedom as to how they can lean their body.

It is therefore clear that when compared to the prior art discussed above, this embodiment 600 offers considerably superior range of motion, as well as significantly more freedom and options for the user's optimal posture and stability. Not only can these benefits provide greater flexibility to a given user during their variegated exercise routine, but it can also more easily accommodate a variety of different users, such as users of different age, gender, body size, body strength and body type, for example.

7

Figure 7:
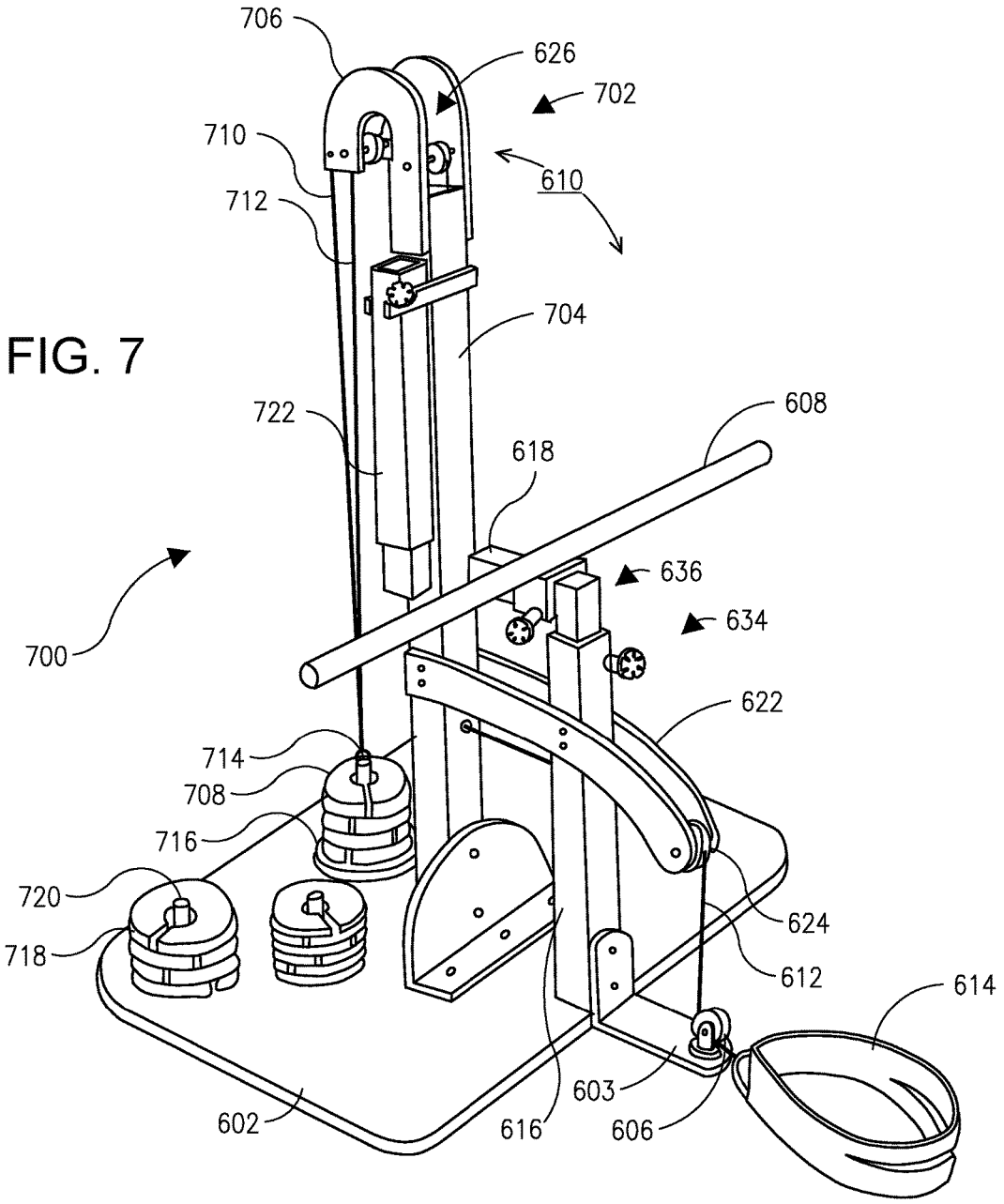

FIG. 7 is a front oblique view of another embodiment of the invention including an open-ended frame. This embodiment 700 shares many of the structural features of the previous embodiment 600 such as its base 602, line-swiveling assembly embodied here as a swiveling pulley 606, adjustable gripping device 608, and some aspects of its frame. However, in place of a conventional weightlifting frame (620) as in the previous embodiment 600, this embodiment 700 instead includes a unique open-ended weightlifting frame 702.

While certain elements shown here (such as the frame 702, for example) are unique to this embodiment 700, the same functional framework of FIG. 3B is present, and achieving the same benefits here as previously discussed. The structural variations of this embodiment 700 therefore do not depart from the essence of the inventive concept. Instead, those variations commingle with and enhance the effectiveness of the functional framework, thereby asserting and demonstrating its value even more clearly.

As in the embodiment of FIG. 6, an inelastic resistance line 612 is guided across the frame via pulleys, including: the intermediate guiding pulley 624 (also sometimes called an intermediate pulley), the internal frame pulley 625 (shown in FIG. 6 but not shown here), and the pair of top frame pulleys 626. All these pulleys 624, 625, 626 function together as a resistance-activating pulley assembly, which in this case is a weightlifting pulley assembly. All pulleys beside the swiveling pulley and intermediate guiding pulley, i.e., pulleys 625, 626 are considered "resistance-activating pulleys."

The open-ended weightlifting frame 702 of this embodiment 700 includes a vertical mast 704 and a mast neck 706 (attached to the top of the mast 704), which houses and supports the pair of top frame pulleys 626. Liftable weight 708 is attached to the line 612 and its gravitational force is shouldered by the neck 706 and mast 704. A stabilizing cable 710 runs adjacent to the weighlifting cable's weighted portion 712, to keep the weight 708 from swinging.

In this embodiment the resistance-transmitting line 612 is attached to a tray adapted to receive and support weights, the tray comprising a vertical stem 718 enclosed around the line 612, and a horizontal circular support platform 716 extending radially from the bottom of the stem 714. The weights 708 can include slits which enable their placement around the stem 714. In this embodiment, unused weights 718 can be stored on other stems 720 attached to the base 602. Other forms of resistance-generating elements (resistance elements) are possible, as discussed below.

As discussed above, given that the user's exercising leg functions as a long lever arm, this device 700 transmits considerable resistance to the user's gluteal muscles. Therefore, the weight system shown can include plates of relatively small weight, thereby enabling the user to modify resistance incrementally. But unlike the conventional weightlifting frame 618, the open-ended frame 702 offers enhanced refinement to the weight adjustment process, thereby enabling a sophisticated resistance-adjustment system.

Unlike the embodiment of FIG. 6, the weight discs 708 shown here can be of varying quantities of light, low increment weight. The discs 708 can easily and securely be added to and removed from the tray in whatever desired combination. Furthermore, this embodiment 700 can be more cheaply manufactured, and more easily transported or moved, than the previous embodiment 600, due to its less bulky frame 702, as well as its more easily removable weights 708.

The finely adjustable weight system allows for strengthening of gluteal muscles without any burdensome or uncomfortable increases in resistance. To further minimize distraction during exercise, the interior of the tray's vertical stem 718 can include a low-friction gliding tube to facilitate the tray's guided movement along the stabilizing cable 710. The bottom of the tray can include rubber bumpers to eliminate noisy impact. The disc weights 708 themselves can include rubber bumpers to avoid clanking due to changes in acceleration during use.

In the embodiment shown 700, the grip height adjustment system 634 and swivel-grip displacement adjustment system 618 can be peg-and-holes, knurled knob systems in their structure and functional operation. In each case, a knurled knob located outside a rectangular outer tube "sleeve" can be loosened to allow a rectangular inner tube to slide freely relative to the outer tube. Retightening of the knurled knob can re-secure the inner tube, in its new position relative to the outer tube.

The knurled knobs are placed on the diagonal, oriented toward a corner of the inner tube. This fastens an opposite external corner of the inner tube against a corresponding internal corner of the outer tube. A peg-and-holes mechanism can be used in tandem with the knurled knob. A locking pin is pulled out of the inner tube enabling it to move freely, then the pin is released to lock into a selected hole. The knurled knob can then tighten as a failsafe, for extra stability.

A vertical support post extension 722 for vertically extending the vertical support post 616 is also shown, stored on the vertical mast 704 portion of the frame. Dramatically extending the height of the vertical support post 616 can be useful in the case of hip flexion, for example, where a user sweeps their leg forward and upward as in a frontal kicking motion (shown in FIG. 10). In such an exercise, ideally the gripping device 608 should be raised well above the height of the user's kick.

8

Figure 8:
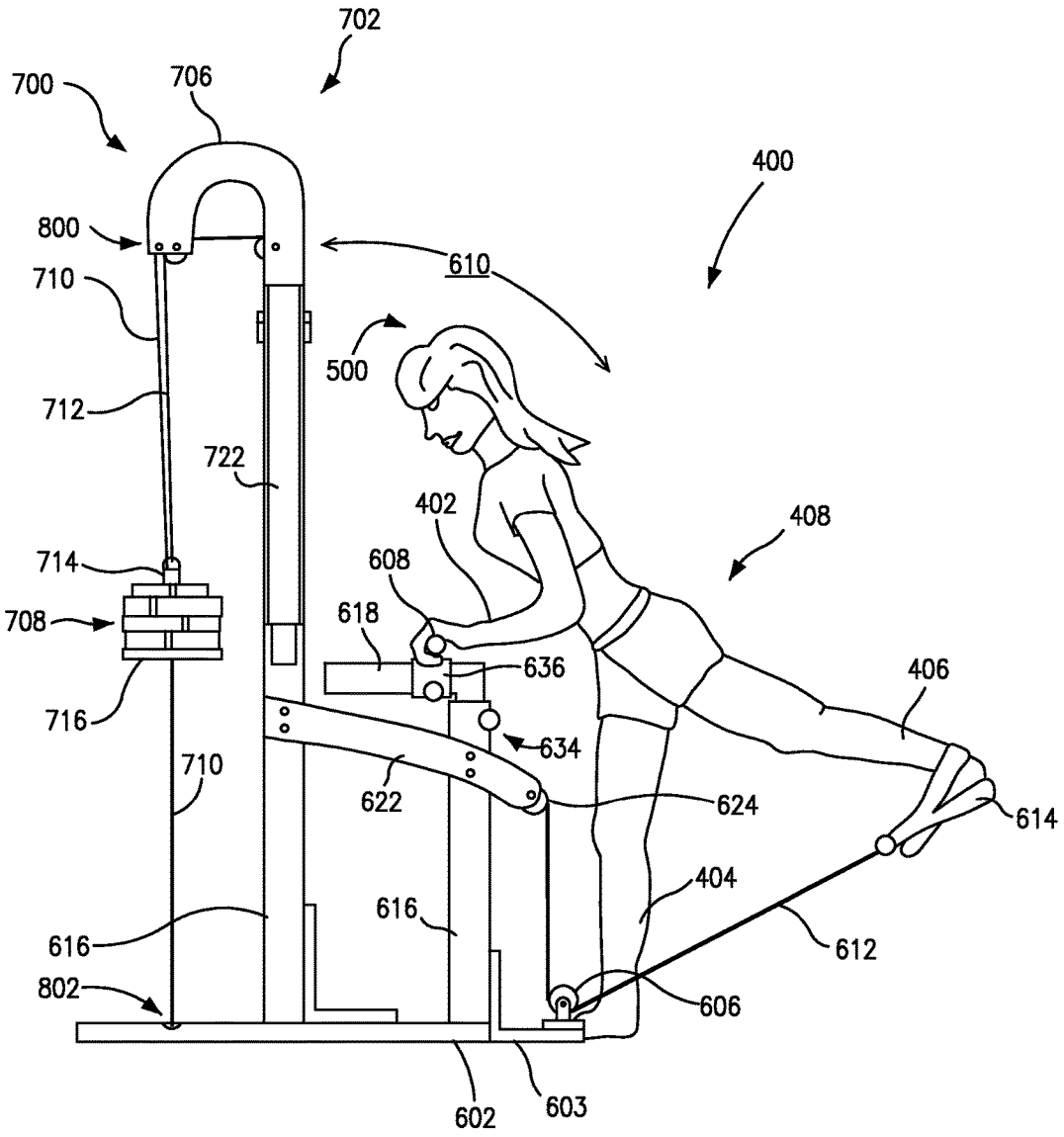

FIG. 8 is a profile view of the embodiment of FIG. 7 being used to fully perform hip extension. As in the prior embodiment 600, the embodiment represented here 700 provides the user with ample headroom 610, allowing for exceptional range of motion during hip extension. As discussed, a unique feature of this embodiment is the open-ended frame 702, which enables the user to calibrate the weight to be lifted on a finer and more personal scale than the previous embodiment 600. In this view, the top and bottom connection points 800, 802 for the stabilizing cable 710 are clearly shown.

The profile view of FIG. 8 helps to illustrate the value of controlling the position of the gripping device 608 relative to the swiveling pulley 606, which can be useful when changing the type of exercise, or as between different users. A non-zero swivel-grip displacement is always advisable, but the precise distance can be calibrated as appropriate. In some cases it may even be advisable to slightly adjust the swivel-grip displacement perhaps due to a change in muscle strength, or even due to a change in a user's ambition regarding their desired muscular development.

9

FIG. 9 is a profile view of the embodiment of FIG. 7 also including a gluteal exercise monitoring system integrated into the open-ended frame. The gluteal exercise monitoring system includes a camera 900, a camera holder 902 for holding the camera 900, an arm 906 supporting the camera holder 902 and suspending the camera 900 in position, a pivot base 906 attached to the mast neck 706 and supporting the arm 904 (allowing the arm 906 to swing to enable the camera 900 to capture different angle views, if desired), and finally a viewing monitor 908 attached to the vertical mast 704.

The gluteal exercise monitoring system can be a valuable feature in helping the user 400 to monitor and assess their form during exercise, such as range of motions, angle and symmetry of movements, and muscles activated for example, and then to adjust accordingly. Proper form has a bearing on muscle development, and yet good form can be difficult to maintain. Poor form can strain a user's back, muscles and/or joints. Avoiding poor form is therefore crucial for an exercise enthusiast.

In the embodiment shown, the camera 900 is trained on the user's buttock area 408 and can also monitor their lower back. This view can enable the user 400 to assess whether their target gluteal muscles are truly being activated. It can also help the user 400 determine whether they are inadvertently putting strain on their lower back, due to poor posture for example. On the other hand, good form can be both encouraged, and validated, during exercise by the exercise monitoring system.

FIG. 10 is a profile view of the embodiment of FIG. 7 being used to perform hip flexion. This exercise can be used to target lower body muscles other than the gluteal muscles, such as the iliopsoas, rectus femoris, and tensor fascia latae, as well as the abdominal muscles. The user 400 may wish to raise their exercising leg 406 straight in front of them. The narrow profile of the frame, and the height-adjustable grip, make the full range of such straight hip flexion motion possible. The thin width of the crossbar line guide 622 allows for full and unimpeded flexion of the exercising leg 406.

Hip flexion can also be performed swiftly for practicing front kicks under force of resistance. This profile view illustrates the value of extending the height of the gripping device 608, which can be achieved by connecting the vertical support post extension 722 to the top of the standard vertical support post 616. Due to the relative weakness of flexor muscles, the weight 1000 can incrementally be calibrated down as appropriate. The gripping device 608 can be adjusted closer to the user in this case.

The integral value of the central swivel straddle stance is apparent when considering the hip flexion exercise shown. As is the case with hip abduction, for example, hip flexion also can be considerably compromised by force vectors orthogonal to the direction of motion of the exercising leg 406. If the user 400 were not straddling the swivel axis during hip flexion, then the direction in which they pull the line 612 would not be directly away from the swiveling pulley 606, and there would be a component vector of force that urges the user's exercising leg 406 off course.

However, as depicted in FIG. 10, the user 400 is able to straddle the swivel axis due to the low profile design of the swiveling pulley 606 and the crossbar line guide 622. While in this swivel straddle stance, the user 400 is able to sweep their leg forward with perfect form. The user 400 can also just as easily perform any desired combination of hip flexion and abduction, adding as much lateral movement to their exercising leg 406 as they wish. Still no distracting force vectors will result, thanks once again to the unobtrusive design elements 606, 622 that enable continuous swivel straddle stance.

In flexing their leg, the user 400 lifts their flexing leg 406 such that it moves to an opposite side of the grip locus 608. The "leg flexion exercise space" required for full range of exercise motion for hip flexion is of greater volume than the normal volume provided under the gripping device 608 during other exercises such as hip extension and abduction. Therefore, the height-adjustable grip is of critical value in enabling full range of motion for hip flexion exercise.

11

FIG. 11 is a front oblique view of another embodiment of the present invention including a frame with a minimalist design. While this embodiment 1100 does share certain core structural features of previous embodiments, it is unique in providing a design that is both robust and streamlined. Like other embodiments, this embodiment 1100 includes a base 1102, a frame 1104 attached to and supported by the base 1102, a line-swiveling assembly 1106 coupled with the base 1102, a gripping device 1108 connected to the frame 1104, and a leaning space 1110 that allows a user to lean their upper body for full range of hip extension and/or abduction.

While certain elements shown here (such as the frame 1104, for example) are unique to this embodiment 1100, the same functional framework of FIG. 3B is present, and achieving the same benefits here as previously discussed. The structural variations of this embodiment 1100 therefore do not depart from the essence of the inventive concept. Instead, those variations commingle with and enhance the effectiveness of the functional framework, thereby asserting and demonstrating its value even more clearly.

As with earlier embodiments, in this embodiment 1100 the line-swiveling assembly 1106 is a swiveling pulley configured to engage with a resistance-transmitting line 1112 to enable a pullable end of the line 1112 to swivel about a vertical swivel axis, thereby allowing a user to pull the pullable end with an exercising leg (via the lower extremity receiving device 1114 or "LERD"), to perform full range of motion for any combination of hip extension and hip abduction under resistance, from a single standing position that substantially straddles the swivel axis of the line-swiveling assembly 1106. As with previous embodiments, a weight machine cable 1112 is being used.

From the line-swiveling assembly 1106, the resistance-transmitting line 1112 is guided across the frame 1104 along a pathway that is laid out by a series of pulleys, discussed below. The frame 1104 itself includes a bowed support post 1116 attached to the base 1102, and a diagonal boom 1118 attached to and supported by the bowed support post. In this embodiment, the frame 1104 can be disassembled by loosening a knurled knob positioned diagonally on the outside of the bowed support post 1116.

The bowed support post 1116 itself includes a lower shaft 1120, an upper shaft 1122, and an elbow 1124 connecting the shafts 1120, 1122. The lower shaft 1120 is secured inside a support post holder 1126. The support post holder 1126 in turn is attached to a frame support plate 1128, which itself is secured to the base 1102. The upper shaft 1122 is configured to receive the diagonal boom 1118, so that the diagonal boom 1118 can be securely attached to the bowed support post 1116 by tightening a knurled knob.

The gripping device 1108 is mounted to the diagonal boom 1118 via a gripping mount 1130 which, in this embodiment, includes adjustment features. The gripping mount 1130 includes a grip-elevation adjustment mechanism 1132, which enables the mount to be positioned at any elevation along the diagonal boom 1118 via loosening and retightening of a knurled knob. Adjusting the elevation of the gripping mount 1130 along the diagonal boom 1118 effectively adjusts the position of the gripping device 1108 relative to the user.

The gripping mount 1130 also includes a grip-depth adjustment mechanism 1134, which adjusts the position of the gripping device relative to the axis of the diagonal boom. In this embodiment, the gripping device 1108 is positioned opposite the diagonal boom 1118 from the user's perspective. The gripping device 1108 can be adjusted closer or farther from the diagonal boom 1118, by loosening and retightening a knurled knob against a slidable adjustment fork. Grip depth adjustment can be useful for positioning the gripping device 1108 for hip flexion exercise, for example.

To position the gripping device 1108 in front of the diagonal boom 1118 from the user perspective, the slidable adjustment fork can be fully removed from its sleeve, then inserted back into the sleeve from the opposite (user) side of the boom. Both the grip-elevation adjustment mechanism 1132 and the grip-depth adjustment mechanism 1134 that are located on the gripping mount 1130 combine to yield a comprehensive swivel-grip displacement adjustment system, providing the user substantial control over the position of the gripping device 1108 including its position relative to the swivel axis, and thus relative to the user.

The line 1112 is a weightlifting cable configured to lift weights when pulled with sufficient force. The weightlifting cable 1112 is guided across the frame 1104 via pulleys. First, it is guided vertically upward from the swiveling pulley 1106 to a strategically placed elbow pulley 1136 inside the elbow 1124 of the bowed support post 1116. It is then guided along the inside of the upper shaft 1122 of the bowed support post 1116, and further along the inside of the diagonal boom 1118, where it then encounters a boom pulley 1138 at the top of the boom 1118. The elbow pulley 1136 and boom pulley 1138 function together as a weightlifting pulley assembly.

A stabilizing cable 1140 drops down from the top edge of the diagonal boom 1118, running adjacent to the weightlifting cable's weighted portion 1142. The weightlifting cable 1112 itself drops vertically down from the boom pulley 1138, connecting at its weighted end to liftable weight 1144. The stabilizing cable 1140 is connected at its top end to the boom 1118 and at its bottom end to a weight support platform 1146, and is held taut between those anchor points to keep the liftable weight 1144 from swinging. The liftable weight 1144 rests on the weight support platform 1146 when it is not being lifted.

The embodiment shown 1100 achieves a robust but streamlined design. The bowed support post 1116 ensures swivel-grip separation, while the diagonal boom 1118 leaves the user ample leaning space 1110. The narrow width of the frame 1104 also facilitates the performance of any desired hip flexion exercises. Given that no frame elements extend outside of the narrow profile that is occupied by the bowed support post 1116 and the diagonal boom 1118, a user's exercising leg can be flexed directly outward and upward, encountering no obstructions along the way.

Also, with a frame 1104 that is strong but minimal in its mass, this embodiment 1100 can function as a weight machine in a professional gym, yet may be disassembled and reassembled at will for easy transport, storage and/or setup. Such a system of knurled knobs as shown here allows for selective separation of the base 1102, bowed support post 1116, diagonal boom 1118, gripping mount 1130, and weight support platform 1146 from each other.

12

FIG. 12 is a top view of the embodiment of FIG. 11 being used to perform a wide spectrum of angular hip exercises. However, this same set of exercises can apply to all embodiments. FIG. 12A depicts a user 1200 using the previous embodiment 1100 to perform hip extension. As discussed above, hip extension is an effective exercise for engaging the gluteus maximus, which is the largest gluteal muscle. It is readily apparent from this view that the user 1200 benefits from being able to lean over the swiveling pulley and the gripping device 1108 to facilitate maximum extension of their exercising leg 1200.

An effective tripod posture can only be achieved if the user stands back from the gripping device. If the line-swiveling assembly (1106, obscured in FIG. 12A) was not set apart from the grip axis 1108, as it is here, then the user 1200 would not be able to come to rest by bringing their exercising leg back to the standing position. Instead, the exercising leg 1202 would have to be advanced farther forward than the standing leg to meet the line-swiveling assembly 1108, before returning to a truly neutral position. By contrast, the swivel straddle stance shown allows for "resting neutral."

FIG. 12B is a top view of the embodiment of FIG. 11 being used to perform simultaneous hip extension and abduction, specifically: half extension, half abduction. The hip has been rotated externally, and the exercising leg 1202 brought 45 degrees laterally from the Sagittal plane. Because this movement follows the orientation of the gluteus maximus fibers (and thereby also avoids contraction of the hamstrings), it completely engages the gluteus maximus: even more so than with pure hip extension.

Hip rotation is made possible by the customized lower extremity device (LERD), described in greater detail above. External (or lateral) rotation of the hip during leg motions that involve some hip abduction activates the gluteus maximus more so than without rotation of the hip. External hip rotation also activates muscles beyond the gluteal muscles, such as the pyriformis, the obturator and gemellus muscles, and still others.

The leg movement shown here is extremely effective in gluteal muscle exercise: in addition to fully engaging the gluteus maximus, the partial hip abduction also strongly engages the gluteus medius and minimus muscles. As discussed above, in contrast to the prior art of FIGS. 1 and 2, here the grip locus is offset from the swivel axis, enabling the user to lean forward to easily execute full range of motion and yielding far superior muscle activation.

This unique leg movement (called "the 45°" due to the angle of the trajectory of the exercising leg relative to the Sagittal plane) is the best combination of hip extension and hip abduction for maximally engaging the gluteus maximus, and is also of central importance in effectively engaging all gluteal muscles in general—especially when combined with external hip rotation, as shown. But in the absence of the displacement of the line-swiveling assembly 1106 from the gripping device 1108, this key exercise would not be achievable with proper form.

If the swivel axis of the line-swiveling assembly 1106 was not set apart from the grip axis of the grip bar 1108, the user 1200 would be compelled to shift their standing position laterally, so that the line's pathway from the line-swiveling assembly 1106 to the user's foot was in line with the movement of their exercising leg 1202. Otherwise, leg movement would be compromised and distracted by a forward-component to the force vector of resistance. Furthermore, the user 1200 would not be able to come to rest at the end of each repetition, for the same reason as noted above in connection with FIG. 12A.

FIG. 12C is a top view of the embodiment of FIG. 11 being used to perform hip abduction. Since hip abduction heavily engages the gluteus medius and minimus muscles, it is essential to a well-balanced treatment of gluteal muscle exercise. Proper form requires a wide grip, as shown. Moreover, separation of the grip locus from the swivel axis is absolutely essential for enabling the user to fully abduct their hip.

Straight hip abduction presents a classic case of the need for a stable tripod posture in achieving maximal gluteal muscle engagement. Without the user's arms functioning as lever arms and applying force in the forward direction, their grip is compelled to counter the abducting leg's torque using purely lateral force instead. This stiffens the body, strains the back, and greatly compromises form and range of motion.

Tripod posture is indispensible to proper hip abduction, yet would not be possible without displacement of the swivel axis from the grip axis. On the other hand, with the swiveling pulley 1106 displaced from the vertical plane of the gripping device 1108 as in the present invention, the user 1200 can fully abduct their exercising leg 1202 with proper tripod posture, stabilizing themselves with their arms instead of their lower back. The customized LERD enables the user to perform hip abduction without any discomfort to the foot.

Finally, FIG. 12D is a top view of the embodiment of FIG. 11 being used to perform hip adduction. This exercise actually can be used to better target the lowest portion of the gluteus maximus, in addition to targeting other muscles such as the adductor muscles. Because a user 1200 must stand to the side of the swivel axis when adducting the hip, in order to keep their exercising leg's 1202 motion in line with the line's pathway, a gripping device 1108 of substantial width is advisable, to allow for tripod posture throughout.

When considering this motion, once again the advantage of a horizontal displacement between the gripping device 1108 and the swiveling pulley 1106 is clear. The user 1200 is able to rest their exercising leg 1202 before and/or after each repetition of the hip adduction movement. This is due to the fact that the pullable end of the resistance-transmitting line is returned to the position of the swiveling pulley 1106 once the exercising leg 1202 returns to the standing position. In this neutral state ("resting neutral"), no resistance is applied.

It should also be noted that each of the exercises shown (as well as still other exercises, such as hip flexion) can be achieved with perfect form from a single standing position that substantially straddles the swivel axis, with continual resistance applied during the entire duration of the exercise, and no resistance applied upon cessation of the exercise. This convenience greatly enhances the qualitative experience of gluteal exercise and muscle development.

The critical importance of the highly versatile central "swivel straddle" stance, in enabling proper form for all manner of gluteal exercise with a resistance-transmitting line, is immediately apparent in FIG. 12, and most specifically, FIGS. 12B and 12C. There, the user 1200 is clearly able to perform any combination of hip extension and abduction without any distracting tangential force vectors compelling their exercising leg 1202 to veer off its intended course. As noted above, this is also the case for any combination of hip abduction and hip flexion (see FIG. 10) attempted.

To be sure, the swivel straddle stance may seem less important during straight hip extension (see FIG. 12A) and hip adduction (see FIG. 12D). These motions conceivably could be executed even if the swiveling pulley 1106 were directly below the gripping device 1108, with the user 1200 out of swivel straddle stance. But even in these narrow instances, the direction and intensity of the force of resistance is more likely to be discontinuous and disrupted if the user 1200 is not straddling the swivel axis.

Nonetheless, the overwhelming majority of possible leg motions for well-rounded gluteal exercise with a line involve at least some degree of (if not substantial) hip abduction (and possibly hip flexion). In all such cases, exercise is greatly compromised if the user 1200 does not assume swivel straddle stance. This stance exclusively allows the user 1200 to perform a wide variety of hip extension and hip abduction combinations with either leg, in full and proper form, without changing position.

FIG. 13 is a front oblique view of another embodiment of the present invention that uses an elastic band to generate resistance. This embodiment 1300 shares many structural features with embodiments discussed earlier, such as a base 1302 and base tongue 1303, a frame 1304, a line-swiveling assembly 1306 (here, a swiveling pulley) attached to the base 1302 via the tongue 1303, an adjustable gripping device 1308 supported by the frame 1304, and a leaning space 1310 afforded by the design of the frame 1304.

While certain elements shown here (such as the frame 1304 and the resistance-generating element 1332, for example) are unique to this embodiment 1300, the same functional framework of FIG. 3B is present, and achieving the same benefits here as previously discussed. The structural variations of this embodiment 1300 therefore do not depart from the essence of the inventive concept. Instead, those variations commingle with and enhance the effectiveness of the functional framework, thereby asserting and demonstrating its value even more clearly.

As with earlier embodiments, the swiveling pulley 1306 engages with a resistance-transmitting line 1312, which can be pulled with an exercising leg via the lower extremity receiving device (LERD) 1314. From the swiveling pulley 1306, the line 1312 is guided across the frame 1304. The frame 1304 itself includes such sub-elements as a vertical support post 1316 attached to the base 1302, a grip support bar 1308 coupled with the vertical support post 1316, and an elastic band mast 1320 attached to and arising from the base 1302.

Also included in the frame 1304 are: a frontal pulley arm 1322; and a rear pulley arm 1324, both of which extend from the vertical support post 1316. The line 1312 is guided across the frame 1304 via a series of pulleys in the following manner. First, the line 1312 is guided vertically upward from the swiveling pulley 1306 to a strategically placed frontal guiding pulley 1326 (a manifestation of the intermediate guiding pulley associated with the functional framework), which is located at the terminus of the frontal pulley arm 1322. Then, the line 1312 is guided horizontally to a rear guiding pulley 1328, located at the terminus of the rear pulley arm 1324.

From the rear guiding pulley 1328, the line 1312 is guided vertically downward to a base pulley 1330 that is attached to the base 1302, after which it rises again to connect to an elastic resistance band 1332 via a metal locking loop 1334, such as a karabiner with a spring-loaded gate, for example. The elastic resistance band 1332 itself runs around an elastic band pulley 1336 attached to an upper portion of the elastic band mast 1320, and then drops down to connect with an elastic band anchor 1338 (which is also attached to the base 1302) via another locking loop 1340.

The frontal guiding pulley 1326, rear guiding pulley 1328, base pulley 1330, and elastic band pulley 1336, function together as a resistance-activating pulley assembly. This "band-stretching" resistance-activating pulley assembly facilitates stretching of the elastic band 1332, which is the means for generating resistance against the pulling of the resistance-transmitting line 1312. Alternative resistance-generating elements other than an elastic band, such as liftable weight or a flexible rod (taught herein), a spring, and still others, will be readily apparent to or within the contemplation of one of ordinary skill in the art.

In the embodiment shown, the resistance transmitted by the line 1312 is generated by the stretching of an interchangeable elastic resistance band 1332 when the pullable end of the line 1312 is pulled with sufficient force. Unlike lifted weights, elastic bands can generate resistance that cannot be diminished via quickly accelerated motion. A selection of other elastic resistance bands of various thickness and resistance value can be provided, for example hanging on the elastic band mast 1320, on the far side of the mast 1320 opposite the elastic band pulley (not shown here). A combination of bands can be attached to the line 1312 for added resistance.

A key advantage of resistance generated by an elastic band 1332 is the linear variability of its resistance. Linear variable resistance is resistance that increases in roughly linear proportion to the amount that a band has already been stretched, which many exercise enthusiasts find particularly beneficial for certain types of exercise. The reason linear variable resistance is often considered so advantageous and conducive to muscle building is that it engages muscles with greater resistance as the muscle's own strength capacity increases, requiring the greatest pulling force at the very apex of an exercise repetition.

As with earlier embodiments, various components of the frame 1304 may be adjusted. Here, the position of the gripping device 1308 can be adjusted in the vertical and horizontal dimensions within the user's Sagittal plane. Here, the height of the gripping device 1308 is controlled by a grip height adjustment system 1342 that extends the vertical support post up and down, while a swivel-grip displacement adjustment 1344 system controls the position of the gripping device horizontally along the grip support bar.

14

FIG. 14 is a front oblique view of another embodiment of the present invention designed to mount to a wall. This embodiment 1400 shares many structural features with embodiments discussed earlier, such as a base 1402, a frame 1404 attached to the base 1402, a line-swiveling assembly 1406 (in this case, a swiveling pulley) attached to the base 1402, an adjustable gripping device 1408 supported by the frame 1404, and a leaning space 1410 afforded by the design of the frame 1404.

While certain elements shown here (such as the base 1402 and the wall mounting bracket 1432) are unique to this embodiment 1400, the same functional framework of FIG. 3B is present, and achieving the same benefits here as previously discussed. The structural variations of this embodiment 1400 therefore do not depart from the essence of the inventive concept. Instead, those variations commingle with and enhance the effectiveness of the functional framework, thereby asserting and demonstrating its value even more clearly.

As with earlier embodiments, the swiveling pulley 1406 engages with a resistance-transmitting line 1412, which can be pulled with an exercising leg via the lower extremity receiving device (LERD), of which one possible embodiment is shown here 1414. From the swiveling pulley 1406, the line 1412 is guided across the frame 1404. The frame itself includes such sub-elements as a pulley assembly housing 1416 with a line passageway 1418, an elastic band mast 1420 attached to and arising from the base, and a grip support 1422 attached to the elastic band mast 1420.

The line 1412 is guided across the frame 1404 via a series of pulleys in the following manner. First, the line 1412 is guided vertically upward from the swiveling pulley 1406 to a strategically placed intermediate guiding pulley 1424 which is located below the distal end of the roof of the pulley assembly housing 1416. Then, the line 1412 is guided diagonally down to an internal base pulley 1426 attached to the base 1402, and adjacent to the elastic band mast 1420. From the internal base pulley 1426, the line 1412 rises vertically, passing through the line passageway 1418 of the line assembly housing 1416 on its way.

The line travels upwards from the internal base pulley, passing vertically through the line passageway to then connect to an elastic resistance band via a metal locking loop, such as a karabiner with a spring-loaded gate, for example. The elastic resistance band itself runs around an elastic band pulley attached to an upper portion of the elastic band mast, and then drops down to connect with an elastic band anchor (not shown, but which is also attached to the base) via another locking loop (also not shown).

The intermediate guiding pulley, internal base pulley, and elastic band pulley, function together as a resistance-activating pulley assembly. This "band-stretching" resistance-activating pulley assembly facilitates stretching of the elastic band, which is the means for generating resistance against the pulling of the resistance-transmitting line. Alternative resistance-generating elements other than an elastic band, such as liftable weight or a flexible rod (taught herein), a spring, and still others, will be readily apparent to or within the contemplation of one of ordinary skill in the art.

As discussed above in connection with FIG. 13, elastic bands can generate resistance that cannot be diminished via quickly accelerated motion. A key advantage of resistance generated by an elastic band is the linear variability of its resistance, which increases in roughly linear proportion to the amount that a band has already been stretched. This variable resistance engages muscles with greater resistance as the muscle's own strength capacity increases. Many exercise enthusiasts find this particularly beneficial for certain types of exercise, including gluteal exercise.

A wall mounting bracket 1434 is adapted to fit across the top of the front face of the elastic band mast 1420, and be affixed to a wall, enabling the machine 1400 to be secured and stabilized despite its small base 1402. A selection of elastic resistance bands of various thickness and resistance value can be made available, by hanging by hooks on the wall mount bracket 1434 for example (not shown here). A combination of bands can be attached to the line for added resistance. An elastic band pole can also be provided (also not shown), for lifting a desired elastic band or multiple bands from their hanging position, to be applied for use.

As with earlier embodiments, various components of the frame 1404 may be adjusted. Here, the position of the elastic band pulley 1432 can be mechanically adjusted up or down along a track by turning a crank 1436, thereby raising or lowering the resistance generated by the elastic band 1428, respectively. The grip support 1422 itself can be adjusted by height, via the loosening and retightening of a knurled knob 1438 within a track. Finally, the grip support 1422 can also be extended outwardly from the elastic band mast 1420 via a swivel-grip displacement adjustment system 1440.

As will be evident upon viewing FIG. 14, embodiments can be conceived of which do not include a base that is designed to support a user. For example, the base 1402 of FIG. 14 is simply a robust protrusion from the bottom of the frame 1404 that supports such elements as the swiveling pulley 1406. In other embodiments, the base may also serve as a platform on which a user can stand. But in embodiments such as FIG. 14, the base does not support the user (who can stand on the floor instead), however it does support other elements, including the swiveling pulley 1406, and frame 1404 elements such as the pulley assembly housing 1416 and elastic band mast 1420.

The embodiment shown 1400 achieves a robust but streamlined design. The pulley assembly housing 1416 ensures swivel-grip separation, while the adjustable grip support 1422 can extend out from the elastic band mast 1420 to yield ample leaning space. With its frame 1404 securely mounted to a wall, this embodiment need not rely on its base 1402 for structural balance and support, thereby benefiting from its small footprint. Once mounted in a strategic location against the wall, the compact design of this embodiment 1400 is minimally obtrusive on its spatial surroundings.

15

FIG. 15 is a front oblique view of another embodiment of the present invention that uses a flexible rod to generate resistance. This embodiment 1500 shares many structural features with embodiments discussed earlier such as a base 1502 (and base tongue 1503), a frame 1504 supported by the base 1502, a line-swiveling assembly 1506 which is a swiveling pulley, an adjustable gripping device 1508 attached to the frame 1504, and a leaning space 1510 afforded by the design of the frame 1504.

While certain elements shown here (such as the frame 1504 and the resistance-generating element 1532, for example) are unique to this embodiment 1500, the same functional framework of FIG. 3B is present, and achieving the same benefits here as previously discussed. The structural variations of this embodiment 1500 therefore do not depart from the essence of the inventive concept. Instead, those variations commingle with and enhance the effectiveness of the functional framework, thereby asserting and demonstrating its value even more clearly.

The swiveling pulley 1506 engages with a resistance-transmitting line 1512, which can be pulled with an exercising leg via the lower extremity receiving device 1514. From the swiveling pulley 1506, the line 1512 is guided across the frame 1504. The frame 1504 itself includes such sub-elements as a vertical support post 1516 attached to the base 1502, a grip support bar 1508 coupled with the vertical support post 1516, and frontal and rear pulley arms 1520, 1522 extending from the vertical support post 1516.

The line 1512 is guided across the frame 1504 via a series of pulleys in the following manner. First, the line 1512 is guided vertically upward from the swiveling pulley 1506 to a strategically placed frontal guiding pulley 1524 which is located at the terminus of the frontal pulley arm 1520. Then, the line 1512 is guided horizontally to a rear guiding pulley 1526, located at the terminus of the rear pulley arm 1522.

From the rear guiding pulley 1526, the line 1512 is guided vertically downward to a frontal base pulley 1528 that is attached to the base 1502, after which it runs back toward the rear corner of the base to connect with a rear corner base pulley 1530. The line 1512 then rises to connect to a free end of a flexible resistance rod 1534 (also known as a tension rod, or "power rod" among some users), the line 1512 being attached to a loop 1534 at the head of the rod 1532, via a metal locking ring such as a karabiner.

The frontal guiding pulley 1524, rear guiding pulley 1526, and rear corner base pulley 1530, function together as a resistance-activating pulley assembly. This "rod-bending" resistance-activating pulley assembly facilitates bending of the flexible rod 1534, which is the means for generating resistance against the pulling of the resistance-transmitting line 1512. Alternative resistance-generating elements other than a flexible rod, such as liftable weight or an elastic band (taught herein), a spring, and still others, will be readily apparent to or within the contemplation of one of ordinary skill in the art.

In the embodiment shown, the resistance transmitted by the line 1512 is generated by the bending of a flexible resistance rod 1532 when the pullable end of the line 1512 is pulled with sufficient force. Unlike lifted weights, flexible resistance rods 1536 can generate resistance that cannot be diminished via quickly accelerated motion. A set of rods 1536 is provided, all supported by a rod support 1538 attached to the base 1502. A single rod 1532 can be attached to the resistance-transmitting line 1512, or a combination of rods 1534 can be attached, for additive resistance.

Another key advantage of resistance generated by a flexible rod 1532 is the progressive variability of its resistance. As indicated above, variable resistance is resistance that increases in proportion to the amount that a band has already been stretched. Variable resistance can be considerably advantageous and conducive to building gluteal muscle, given that it requires the greatest amount of pulling force at the very apex of leg motion (such as hip extension and/or hip abduction leg motion in this case), which is precisely when the gluteal muscles are in the best position for optimal muscle engagement.

As with earlier embodiments, various components of the frame 1504 may be adjusted. Here, the position of the gripping device 1508 can be adjusted in the vertical and horizontal dimensions within the user's Sagittal plane. Here, the height of the gripping device 1508 is controlled by a grip height adjustment system 1540 that extends the vertical support post up and down, while a swivel-grip displacement adjustment 1542 system controls the position of the gripping device horizontally along the grip support bar.

CONCLUSION

In all the embodiments shown and described, straight-legged movements have received the greatest attention, to illustrate the wide range of motion available to a user of the present invention. However, the present invention allows for a wide variety of leg postures, with the knee bent at any desired angle. Furthermore, the orientation and trajectory of the leg can change and/or rotate, even throughout a single repetition.

At the same time, it should be noted that one of the unique benefits of the present invention is its ability to enable a user to exercise their gluteal muscles with maximal effectiveness through straight-legged movements. This is a significant benefit indeed, given its ergonomic and orthopedic implications: straight-legged movement from a single standing position is less likely to compromise the knees and joints than are other rigorous gluteal exercise routines, such as squats or lunges for example.

The spatial arrangement and spatial relationship of key elements of the present invention have been defined in functional terms, and the structures of the embodiments have been taught so as to emphasize their accomplishment of those functions. For example, in certain embodiments shown and described above, the line-swiveling assembly has been taught as a small swiveling pulley attached directly to the base, as one possible approach to its design as a functional element.

The key functional objective which the spatial arrangement and spatial relationship of the elements is taught to achieve, is enabling a user to perform full range of motion for any combination of hip extension and abduction under the continuous force of applied resistance transmitted via an exercise line, from a single standing position, while constantly maintaining tripod posture. The key elements and their relative positioning combine to synergistically create and enable this functional capacity.

The functional framework creates the geometrical template of elements that make it possible for a user to straddle the swivel axis. From this central "swivel straddle" stance, the user is able to focus exclusively on engaging their gluteal muscles. Their leg moves unimpeded by any orthogonal force vectors, no matter what combination of hip extension and hip abduction they choose to perform. Their body is free to lean to balance their efforts, and does not need to counter any torque force. And at the end of every set, resistance is eliminated as the user returns to the resting standing position.

For these reasons, the functional framework as explained in connection with FIG. 3B and demonstrated in this specification in some ways can be considered a cornerstone of the present invention. The swivel-grip separation and leaning space present in the embodiments taught and described herein cooperate together to promote healthy posture, and enable vigorous and high-efficiency gluteal exercise. By assuming tripod posture and performing full range of motion, all while constantly maintaining proper anatomical form, a user is capable of producing exceptional results.

In some cases, spatial relationships such as distances between elements or between geometrical references are indicated using anatomical references. For example, the grip locus can be substantially at least "shoulder's width" across, and/or no higher than substantially "hip height" above the base, and/or substantially at least "forearm length" from the swivel axis. Use of such references may be favorable when the distances themselves, and/or (just as significantly) the proportions between those distances, can be seen as functionally related to the user's body.

Even a seemingly small separation between the grip locus and swivel axis, such as 6 inches for example, can allow for tripod posture, but a given user may find a certain longer distance to be optimal for a particular purpose. Personal preference is more easily satisfied when a user is able to control the position of the gripping device relative to the swivel axis, to suit the user's specific exercise objectives at the time.

In the description of the above embodiments, it is explained that a resistance-transmitting line is coupled with a resistance-generating element such that pulling the line can activate the resistance-generating element, thereby generating resistance against the pulling. This resistance-generating element can be liftable weight, stretchable bands, and/or tension rods, for example. Other possible resistance-generating elements will be readily apparent to one of ordinary skill in the art.

The scope of possible resistance-generating elements (or "resistance elements") can also include, but is not limited to: linear spring resistance (potentially adjustable); torsional spring-loaded cable spools; and/or torsional rubber resistance. One embodiment of torsional rubber resistance can include twistable, injection-molded elastomeric torsional shapes, often marketed as SpiraFlex® "flex disks." Such flex disks can be connected in series or parallel, and can provide linear resistance as opposed to progressive resistance. These and still other resistance-generating elements are within the contemplation of one of ordinary skill.

The apparatus taught and described herein, with its unique synergistic combination of functional elements, is dedicated to providing an optimal experience and achieving optimal results in gluteal muscle training, sculpting, and building. While other lower body exercise machines and/or devices may achieve some portion of the objectives outlined here, the present invention uniquely enables maximal engagement of the gluteal muscles, while also providing a new and enhanced level of safety and comfort.

The present invention combines key elements in a uniquely advantageous arrangement to accomplish a specific function. Other modifications and implementations of the invention will occur to one skilled in the art, without departing from the spirit and the scope of the invention as claimed. Accordingly, the above description is not intended to limit the invention, except as indicated in the following claims.

What is claimed is:

1. A lower body fitness apparatus, comprising:

a base;

a frame coupled to and supported by the base;

a line-swiveling pulley coupled with the base, the line-swiveling pulley being configured to engage with an inelastic resistance-transmitting line, to enable a pullable end of the resistance-transmitting line to swivel about a vertical swivel axis to allow a user to pull the pullable end with an exercising leg to perform full range of exercise motion for any combination of hip extension and hip abduction at maximal muscle engagement, from a single standing position that substantially straddles that swivel axis;

a gripping device connected to the frame, the gripping device including a plurality of grippable areas positioned along a substantially horizontal grip locus, the grip locus being of sufficient span, and sufficient position relative to the swivel axis, to allow the user to stabilize themselves in a tripod posture formed by both arms and a standing leg during the full range of exercise motion for any combination of hip extension and hip abduction at maximal muscle engagement from the single standing position; and a resistance-activating pulley assembly adapted to guide the line, in a horizontal portion of its pathway, from the swivel axis toward the grip locus, to facilitate engagement of the line with a resistance element while preserving leaning space, the leaning space passing from a location of the standing position through the swivel axis and over the grip locus to an opposite side of the grip locus relative to the swivel axis, and having sufficient volume to allow the user to lean their upper body opposite their exercising leg to achieve full range of exercise motion during the any combination of hip extension and hip abduction at maximal muscle engagement from the single standing position.

2. The fitness apparatus of claim 1, wherein the frame includes a transverse arm that guides the resistance-transmitting line from a front end of the frame to a rear end of the frame via pulleys of the resistance-activating pulley assembly.

3. The fitness apparatus of claim 2, wherein the transverse arm extends forward beyond the grip locus and supports an intermediate guiding pulley of the resistance-activating pulley assembly, at a proximal end of the transverse arm, thereby creating horizontal displacement between the grip locus and the swivel axis.

4. The fitness apparatus of claim 1, wherein the frame is configured to enable the resistance-transmitting line to couple a lower extremity receiving device with the resistance element to enable full range of motion for hip extension and hip abduction exercise.

5. The fitness apparatus of claim 4, wherein the frame includes a resistance-activating pulley assembly, including an intermediate guiding pulley; and a resistance-activating pulley, in communication with each other and with the line-swiveling pulley, to enable the resistance-transmitting line to couple the lower extremity receiving device with the resistance element to provide resistance for full range of motion of hip extension and hip abduction exercise.

6. The fitness apparatus of claim 1, wherein the frame enables the user to perform hip flexion and circumferential leg sweep.

7. The fitness apparatus of claim 6, wherein the gripping device and the resistance generating element are supported by vertical posts.

8. The fitness apparatus of claim 6, wherein the gripping device is configured to extend above a leg flexion exercise space required for full range of exercise motion for hip flexion, during which the user lifts a flexing leg forward to an opposite side of the grip locus.

9. The fitness apparatus of claim 1, wherein the line-swiveling pulley and the frame are configured to enable the user to pull the pullable end of the line with the exercising leg to perform hip flexion.

10. The fitness apparatus of claim 1, further comprising a resistance adjustment system.

11. The fitness apparatus of claim 1, wherein the line-swiveling pulley is configured to couple with the resistance-transmitting line, the line-swiveling pulley being free to swivel about the swivel axis.

12. The fitness apparatus of claim 1, wherein the gripping device is configured to support the user during hip adduction.

13. The fitness apparatus of claim 1, wherein the gripping device includes a straight bar positioned along a horizontal grip axis.

14. The fitness apparatus of claim 1, wherein the gripping device is height-adjustable.

15. The fitness apparatus of claim 1, further comprising a swivel-grip displacement adjustment system, the swivel-grip adjustment system being configured to enable adjustment of displacement between the swivel axis and the grip locus.

16. The fitness apparatus of claim 1, wherein the frame provides sufficient stability against torque without requiring the user to stand on the base, thereby enabling the line-swiveling pulley to be attached to the base via a tongue.

17. The fitness apparatus of claim 1, wherein the resistance-transmitting line is routed from its pullable end horizontally to the line-swiveling pulley at the base, then vertically upward to an intermediate guiding pulley of the resistance-activating pulley assembly at a proximal end of a transverse arm, then along the transverse arm toward a rear end of the frame to a resistance-activating pulley of the resistance-activating pulley assembly at a distal end of the transverse arm, such that the line is configured to communicate with the resistance element to provide resistance for full range of motion of hip extension and hip abduction exercise.

18. The fitness apparatus of claim 1, wherein the apparatus is adapted to rout the line:

a) from its pullable end to the line-swiveling pulley that is positioned at a front end of the apparatus in front of the gripping device, at the base; then b) from the line-swiveling pulley upward and rearward to a rear end of the apparatus behind the gripping device, via the resistance-activating pulley assembly, such that the line provides both:

i) resistance from the resistance element at the rear end; and ii) extensiveness of the leaning space extending continuously from the front end, over the gripping device, to the rear end, for full range of motion of any combination of hip extension and hip abduction exercise.

* * * * *